US010759170B2

(12) United States Patent
Yamamoto et al.

(10) Patent No.: US 10,759,170 B2
(45) Date of Patent: Sep. 1, 2020

(54) INK JET PRINTING APPARATUS

(71) Applicant: RISO KAGAKU CORPORATION, Tokyo (JP)

(72) Inventors: Hirotaka Yamamoto, Ibaraki (JP); Ami Nakata, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/257,808

(22) Filed: Jan. 25, 2019

(65) Prior Publication Data

US 2019/0232662 A1 Aug. 1, 2019

(30) Foreign Application Priority Data

Jan. 30, 2018 (JP) ..... 2018-013148
Jan. 24, 2019 (JP) ..... 2019-009837

(51) Int. Cl.

| | |
|---|---|
| ***B41J 2/165*** | (2006.01) |
| ***B41J 2/14*** | (2006.01) |
| ***B41J 2/17*** | (2006.01) |
| ***B41J 2/175*** | (2006.01) |
| *B41J 2/185* | (2006.01) |

(52) U.S. Cl.

CPC ..... *B41J 2/16505* (2013.01); *B41J 2/1433* (2013.01); *B41J 2/1652* (2013.01); *B41J 2/16508* (2013.01); *B41J 2/16517* (2013.01); *B41J 2/1721* (2013.01); *B41J 2/17596* (2013.01); *B41J 2/16526* (2013.01); *B41J 2/16532* (2013.01); *B41J 2/16535* (2013.01); *B41J 2/16538* (2013.01);

(Continued)

(58) Field of Classification Search

CPC .. B41J 2/16505; B41J 2/1433; B41J 2/16508; B41J 2/16517; B41J 2/1652; B41J 2/1721; B41J 2/17596

See application file for complete search history.

(56) References Cited

U.S. PATENT DOCUMENTS 4,819,012 A 4/1989 Kiyohara et al.
5,552,811 A 9/1996 Kurata et al.

(Continued)

FOREIGN PATENT DOCUMENTS

EP 3144152 3/2017
GB 2112715 7/1983

(Continued)

OTHER PUBLICATIONS

Partial European Search Report issued in corresponding EP patent application No. 19153931.1 dated Jun. 19, 2019.

(Continued)

*Primary Examiner* — Jason S Uhlenhake

(74) *Attorney, Agent, or Firm* — Greenblum & Bernstein, P.L.C.

(57) ABSTRACT

The ink jet printing apparatus includes: an ink jet head having a nozzle row in which a plurality of nozzles for ejecting ink are arranged and a nozzle guard with an opening at a portion corresponding to the nozzle row, provided at a position via a gap with respect to an ink ejection surface of the nozzle row; a sheet shaped absorbing member having a size that covers a range of the opening of the nozzle guard; and a capping unit that presses the absorbing member onto the opening of the nozzle guard.

13 Claims, 17 Drawing Sheets

(52) U.S. Cl.
CPC .. *B41J 2/16552* (2013.01); *B41J 2002/16502* (2013.01); *B41J 2002/1856* (2013.01)

(56) References Cited

U.S. PATENT DOCUMENTS

| | | | | |
|---|---|---|---|---|
| 9,067,415 | B2 | 6/2015 | Fukuda et al. | |
| 2003/0218652 | A1* | 11/2003 | Nakashima | B41J 29/17 347/31 |
| 2011/0285785 | A1 | 11/2011 | Hayashi | |
| 2016/0347068 | A1 | 12/2016 | Nawano et al. | |
| 2017/0113463 | A1 | 4/2017 | Harada et al. | |
| 2017/0203572 | A1* | 7/2017 | Takekoshi | B41J 2/16517 |
| 2017/0259575 | A1 | 9/2017 | Nakano | |
| 2017/0297339 | A1* | 10/2017 | Midorikawa | B41J 2/16538 |

FOREIGN PATENT DOCUMENTS

| | | |
|---|---|---|
| JP | 5-104734 | 4/1993 |
| JP | 10-235894 | 9/1998 |
| JP | 2002-127440 | 5/2002 |
| JP | 2007-261258 | 10/2007 |
| JP | 2012-143947 | 8/2012 |
| JP | 2016-32930 | 3/2016 |
| JP | 2016-74176 | 5/2016 |
| JP | 6147582 | 5/2017 |

OTHER PUBLICATIONS

Extended European Search Report for EP App. No. 19153931.1 dated Oct. 24, 2019.

* cited by examiner

INK JET PRINTING APPARATUS

CROSS-REFERENCE TO RELATED APPLICATIONS

The present application claims priority under 35 U.S.C. § 119 to Japanese Patent Application No. 2018-13148, filed on Jan. 30, 2018 and Japanese Patent Application No. 2019-9837, filed on Jan. 24, 2019. The above applications are hereby expressly incorporated by reference, in its entirety, into the present application.

BACKGROUND OF THE INVENTION

1. Field of the Invention

The present invention is related to an ink jet printing apparatus having an ink jet head for ejecting ink.

Ink jet printing apparatuses that eject ink from an ink jet head to administer printing on print media such as paper and film have been proposed. Utilizing such ink jet printing apparatuses to perform printing processes on base materials such as building materials and decorative panels has also been proposed.

There are some print media for printing by ink jet printing apparatuses, which are curved or have protrusions and recesses on the surfaces thereof. When printing is performed on such a print medium, there is a possibility that an ink ejection surface of an ink jet head, at which the tip of a nozzle is exposed, will contact the print medium, because the distance between the print medium and the ink jet head varies depending on the printing position of the print medium.

In the case that the print medium contacts the ink ejection surface, an ink repellent film which is formed on the ink ejection surface may be damaged. If the ink repellent film is damaged, it will become more likely for ink to adhere to the ink ejection surface, and there is a possibility that the adhered ink will cause ejection failure of the ink from the nozzle, which may decrease print image quality.

Therefore, providing a protective member called a nozzle guard to protect the surface of an ink ejection surface of an ink jet head has been proposed (Japanese Unexamined Patent Publication No. 2016-74176, for example).

In ink jet printing apparatuses, ink or dust such as paper dust, which is generated from paper sheets, may adhere to an ink ejecting port of a nozzle. In the case that ink adheres to or paper dust accumulates on the ink ejecting port of the nozzle, ejection defects such as irregularities in the ejection direction of ink from the nozzle or ejection failure may occur.

Performing a series of operations for forcibly ejecting ink from a nozzle of an ink jet head, that is, performing a so called purge, and then wiping an ink ejecting port of the nozzle with a wipe blade, is a known procedure for reducing such ejection defects. By performing this procedure, the wipe blade removes ink which is adhered to the ink ejecting port of the nozzle as well as dust from the ink ejecting port of the nozzle.

For example, Japanese Unexamined Patent Publication No. 2016-32930 proposes an apparatus that performs a wiping operation by moving a wipe blade from a first short side to a second short side that faces the first short side of a rectangular ink ejection surface.

SUMMARY OF THE INVENTION

Here, some ink jet heads having the aforementioned nozzle guard have gaps between an ink ejection surface and the nozzle guard. In the case that the aforementioned purging and wiping operations are performed in such an ink jet head, a portion of ink which is adhered to the ink ejection surface may enter the gap between the ink ejection surface and the nozzle guard.

It is extremely difficult to remove ink which has entered the gap by a wiping operation. As disclosed in Japanese Unexamined Patent Publication No. 2016-32930 for example, when the wiping operation is performed by moving the wipe blade from the first short side to the second short side of the rectangular ink ejection surface, although it may be possible to remove ink from a gap on the first short side, it is difficult to remove the ink from the gaps at the remaining three sides of the rectangular ink ejection surface.

In addition, in the case of a system that performs a printing process while moving the ink jet head, during the printing process, there is a possibility that ink which has entered a gap will move to the side of the opening of a nozzle guard and block the ink ejecting port of a nozzle due to the movement of the ink jet head, resulting in ejection failure.

Further, during a standby state in which a printing process is not being performed, an opening of a nozzle guard is sealed by a cap to prevent the tip of a nozzle from drying. However, there is a possibility that ink which has entered a gap will move to the side of the opening of the nozzle guard and block the ink ejecting port of the nozzle by repeating opening and closing operations of the cap, resulting in ejection failure.

Japanese Patent No. 6147582 discloses a method for suppressing ink within a gap between a nozzle guard and an ink ejection surface from seeping out onto the ink ejection surface, by weakening the pressure by which the cap is pressed against the ink jet head when maintenance is performed by suctioning ink with the aforementioned cap.

However, because the method disclosed in Japanese Patent No. 6147582 is not a method for directly removing the ink in the gap between the nozzle guard and the ink ejection surface, there is a possibility that the ink within the gap will move onto the ink ejection surface due to movement of an ink jet head to block an ink ejecting port of a nozzle, resulting in ejection failure.

The present invention has been developed in view of the foregoing circumstances. It is an object of the present invention to provide an ink jet printing apparatus capable of removing ink in a gap between a nozzle guard and an ink ejection surface, and suppressing ejection failure caused by movement of an ink jet head.

An ink jet printing apparatus of the present invention comprises:

an ink jet head having a nozzle row in which a plurality of nozzles for ejecting ink are arranged and a nozzle guard with an opening at a portion corresponding to the nozzle row, provided at a position via a gap with respect to an ink ejection surface of the nozzle row;

a sheet shaped absorbing member having a size that covers a range of the opening of the nozzle guard; and a pressing mechanism for pressing the absorbing member onto the opening of the nozzle guard.

The ink jet printing apparatus of the present invention is provided with the sheet shaped absorbing member having a size that covers the range of the opening of the nozzle guard of the ink jet head, and the absorbing member is pressed onto the opening of the nozzle guard by the pressing mechanism. Therefore, ink in the gap between the nozzle guard and the ink ejection surface can be removed. Accordingly, even in the case that the ink jet head is moved, it is possible to suppress ejection failure caused by movement of the ink jet head.

DETAILED DESCRIPTION OF THE EMBODIMENTS

Hereinafter, an embodiment of an ink jet printing apparatus of the present invention will be described in detail with reference to the attached drawings. The characteristic features of the ink jet printing apparatus of the present embodiment lie in a maintenance mechanism of an ink jet head and the manner of control thereof. First, the configuration of the entire ink jet printing apparatus will be described. FIG. is a perspective view that illustrates the schematic configuration of an ink jet printing apparatus 1 of the present embodiment. Note that in the description of the embodiment to follow, In the description of the embodiments described below, the up, down, left, right, front, and back directions indicated by arrows in FIG. 1 are defined as the upper, lower, left, right, front, and back directions of the ink jet printing apparatus 1.

Figure 1:
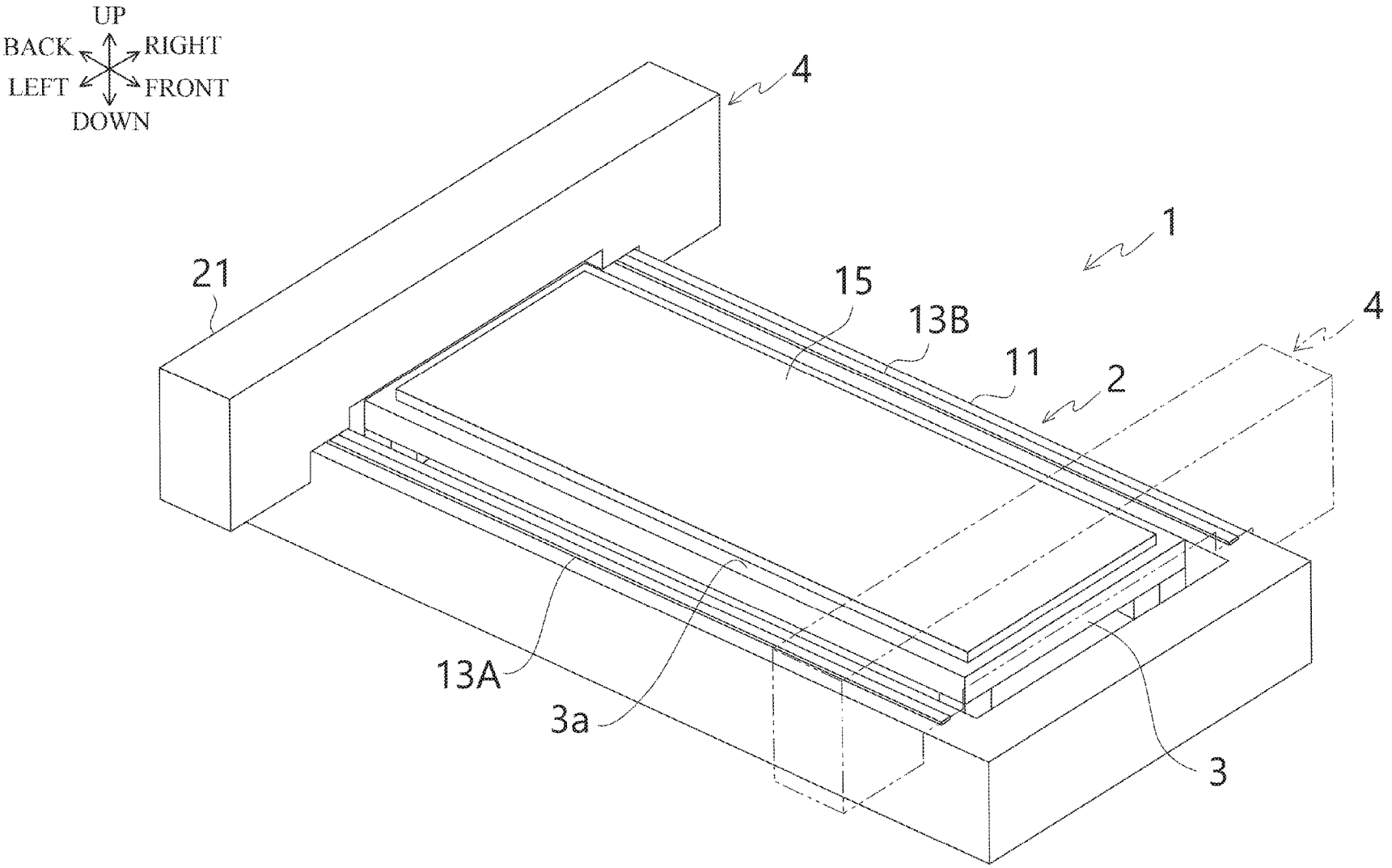
FIG. 1 is a perspective view that illustrates the schematic configuration of an embodiment of an ink jet printing apparatus of the present invention.

As illustrated in FIG. 1, the ink jet printing apparatus 1 of the present embodiment is equipped with a shuttle base unit 2, a flatbed unit 3, and a shuttle unit 4.

The shuttle base unit 2 supports the shuttle unit 4 and moves the shuttle unit 4 in the front-back direction (sub scanning direction). Specifically, the shuttle base unit 2 is equipped with a gantry section 11 and a sub scanning drive motor 12 (refer to FIG. 9).

The gantry section 11 is formed in the shape of a rectangular frame and supports the shuttle unit 4. Sub scanning drive guides 13A and 13B that extend in the front-back direction are respectively formed above the left and right sides of the frame of the gantry section 11. The sub scanning drive guides 13A and 13B guide the shuttle unit 4 so as to move in the front-back direction. The sub scanning drive motor 12 moves the shuttle unit 4 in the front-back direction.

The flat bed unit 3 supports a print medium 15 such as a building material or a decorative panel. The flat bed unit 3 is arranged in a rectangular parallelepiped shaped recess formed inside the gantry section 11 of the shuttle base unit 2. The flat bed unit 3 has a medium mounting surface 3*a*, which is a horizontal surface on which the print medium 15 is placed. The flat bed unit 3 has an elevating mechanism that includes a hydraulic drive mechanism (not shown) or the like such that the height of the medium mounting surface 3*a* can be adjusted.

Figure 2:
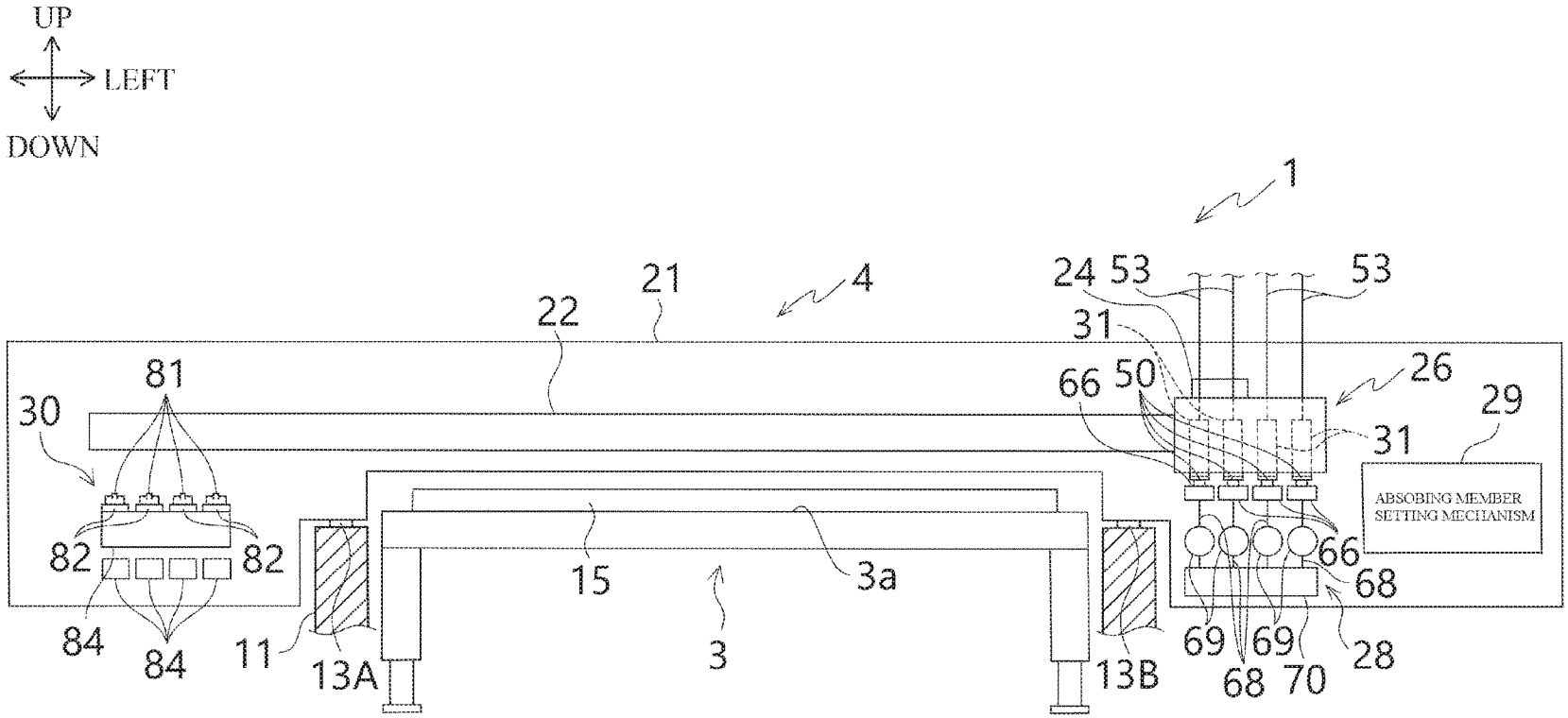
FIG. 2 is a diagram that illustrates the schematic configuration of a shuttle unit.

The shuttle unit 4 performs printing processes on the print medium 15. FIG. 2 is a diagram that illustrates the schematic configuration of the shuttle unit 4. As illustrated in FIG. 2, the shuttle unit 4 is equipped with a casing 21, a main scanning drive guide 22, a main scanning drive motor 23 (refer to FIG. 9), a head elevating guide 24, a head elevating motor 25 (refer to FIG. 9), a head unit 26, a capping unit 66, a suction unit 28, an absorption member setting mechanism 29, and a maintenance unit 30.

The casing 21 accommodates components such as the head unit 26. The casing 21 is formed in a portal shape so as to straddle the flatbed unit 3 in the left-right direction. The casing 21 is supported by the gantry portion 11 of the shuttle base unit 2 and is configured to be movable along the sub scanning drive guides 13 A and 13B.

The main scanning drive guide 22 guides the head unit 26 so as to move in the left-right direction (main scanning direction). The main scanning drive guide 22 is formed by an elongated member that extends in the left-right direction. The head unit 26 is moved in the left-right direction by the main scanning drive motor 23.

The head elevating guide 24 guides the head unit 26 to move in the up-down direction. The head elevating guide 24 is formed by a member having a shape which is elongated in the up-down direction. The head elevating guide 24 is configured to be movable in the left-right direction along the main scanning drive guide 22 together with the head unit 26. The head unit 26 is moved up and down in the up-down direction by the head elevating motor 25.

The head unit 26 performs printing processes by ejecting ink onto the print medium 15 while moving in the left-right direction along the main scanning drive guide 22 in the manner described above. As illustrated in FIG. 2, the head unit 26 has four ink jet heads 31.

Figure 3:
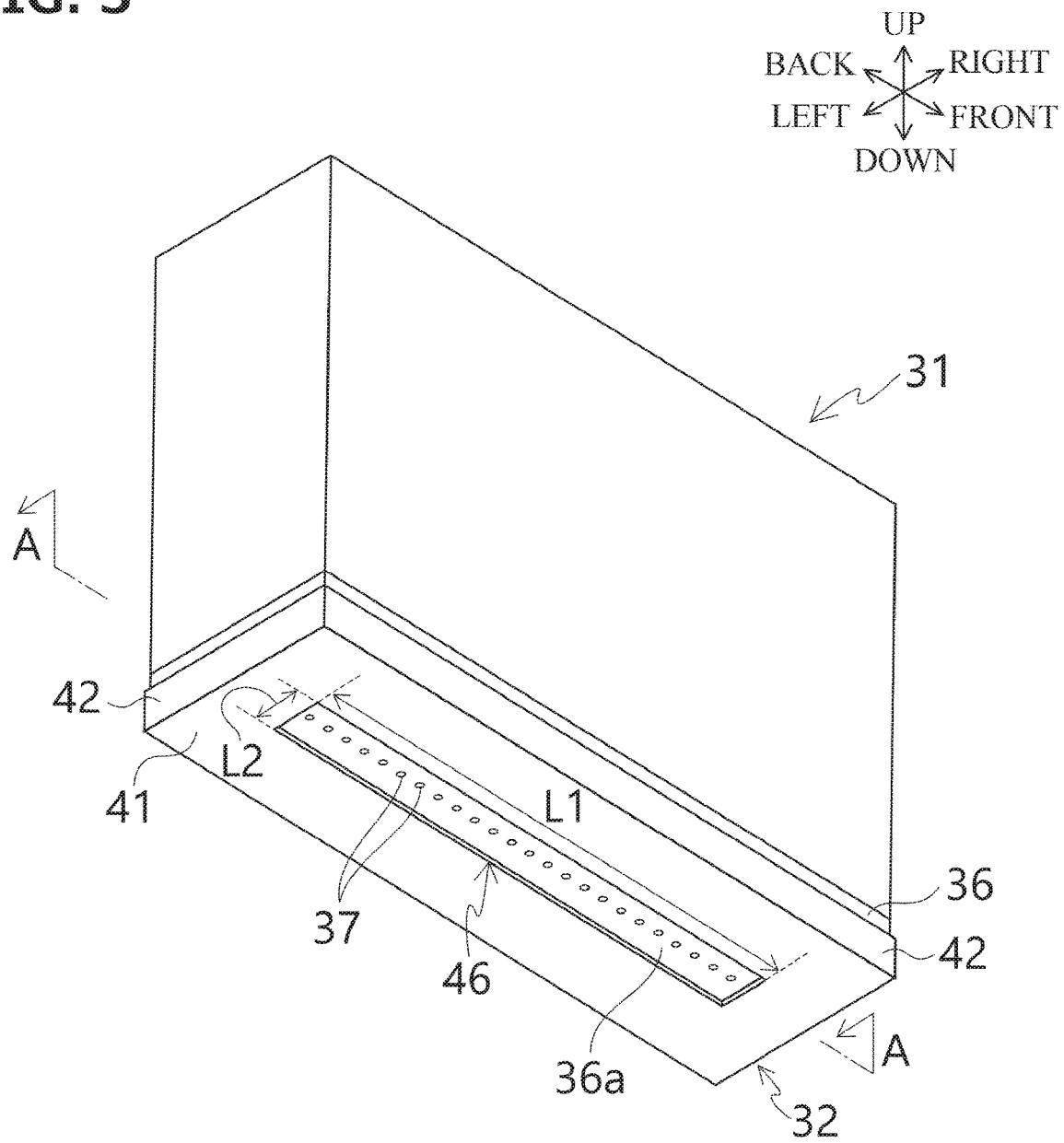
FIG. 3 is a perspective view that illustrates the outer appearance of an ink jet head.
Figure 4:
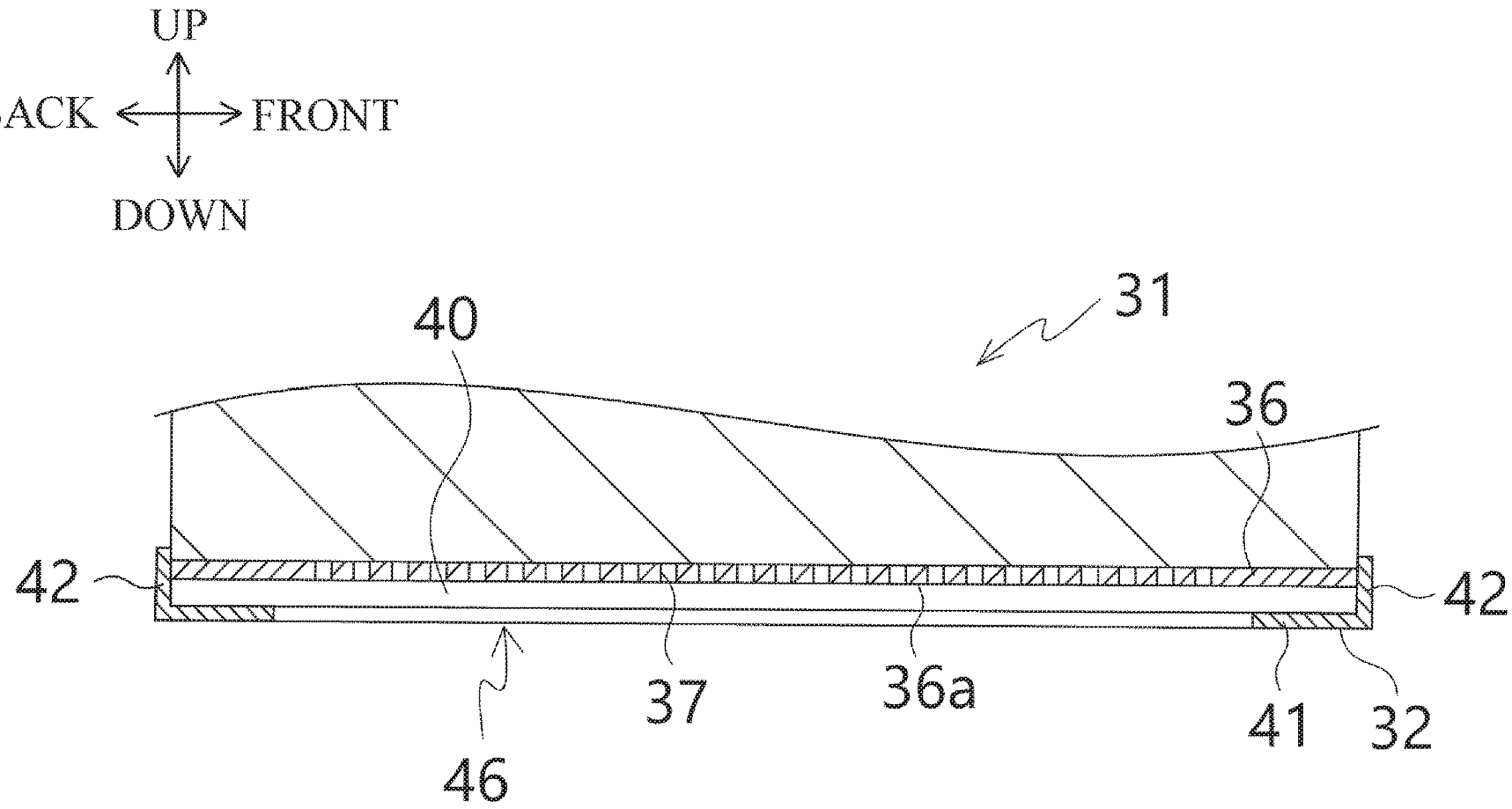
FIG. 4 is a diagram that illustrates a portion of a cross section of the ink jet head illustrated in FIG. 3 taken along line A-A of FIG. 3.

FIG. 3 is a perspective view that illustrates the outer appearance of an ink jet head 31, and FIG. 4 is a diagram that illustrates a portion of the cross section of the ink jet head 31 taken along line A-A of FIG. 3.

As illustrated in FIG. 3, the ink jet head 31 is equipped with a nozzle plate 36 and a nozzle guard 32. The nozzle plate 36 has a nozzle row in which a plurality of ink ejecting ports 37 of nozzles that eject ink are arranged in the front-back direction.

As illustrated in FIGS. 3 and 4, the nozzle guard 32 has an opening 46 at a portion that corresponds to the nozzle row of the nozzle plate 36, and is provided at a position via a gap 40 with respect to an ink ejection surface 36*a* of the nozzle row. In the present embodiment, the ink ejection surface 36*a* is the same surface as the surface of the nozzle plate 36.

The nozzle guard 32 protects the ink ejection surface 36*a* of the nozzle plate 36. Specifically, the nozzle guard 32 has a bottom plate 41 formed so as to cover the periphery of the nozzle row, and a side wall 42 erected on the peripheral edge of the bottom plate 41. The aforementioned opening 46 is formed in the bottom plate 41, and the gap 40 is formed between the bottom plate 41 and the ink ejection surface 36*a*. The opening 46 is formed in a rectangular shape which is elongated in the front-back direction and is formed so as to expose the ink ejecting ports 37 of all of the nozzles.

The four ink jet heads 31 are arranged in parallel in the left-right direction. The four ink jet heads 31 eject inks of different colors (for example, cyan, black, magenta, and yellow).

The capping unit 66 seals the opening 46 of the nozzle guard 32 in order to prevent the ink ejecting ports 37 of the nozzles from drying while the ink jet printing apparatus 1 is not performing a printing process and is in a standby state. In the present embodiment, the capping unit 66 corresponds to a pressing mechanism of the present invention.

The capping unit 66 is installed within the right end portion of the casing 21 as illustrated in FIG. 2. When the head unit 26 moves to a standby position at the right end portion of the casing 21, the opening 46 of the nozzle guard 32 is hermetically sealed.

Figure 5:
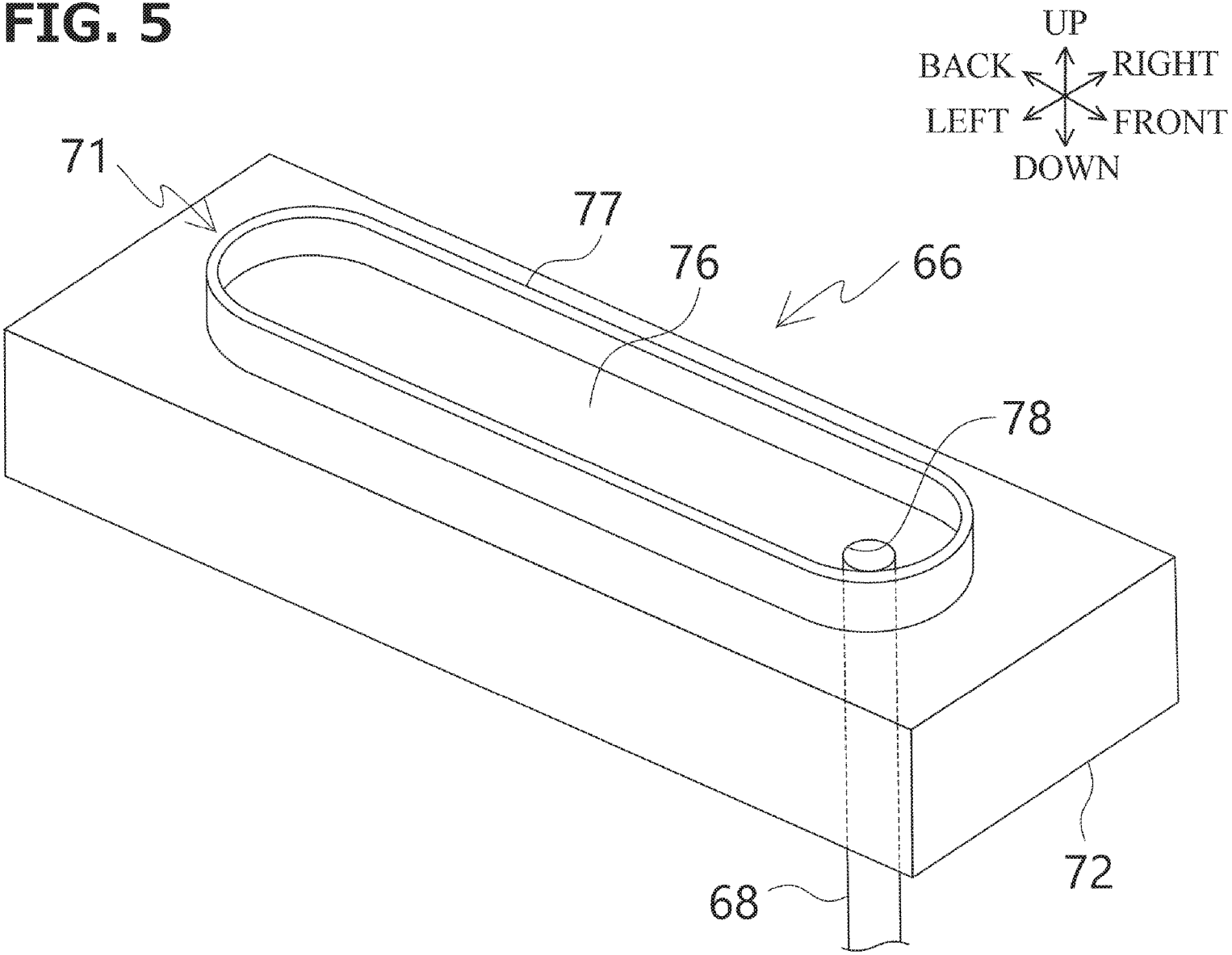
FIG. 5 is a diagram that illustrates the schematic configuration of a capping unit.

As illustrated in FIG. 5, the capping unit 66 is equipped with a cap 71 (corresponding to a cap member of the present invention) and a cap base 72. The cap 71 has an ellipsoid bottom portion 76 and a peripheral wall 77 erected from the peripheral edge of the bottom portion 76. A suction aperture 78 for suctioning ink which is absorbed by an absorbing member 50, which will be described later, is formed in the bottom portion 76. A suction pipe 68 of a suction unit 28 to be described later is connected to the suction hole 78. The cap base 72 is a base on which the cap 71 is formed.

Figure 9:
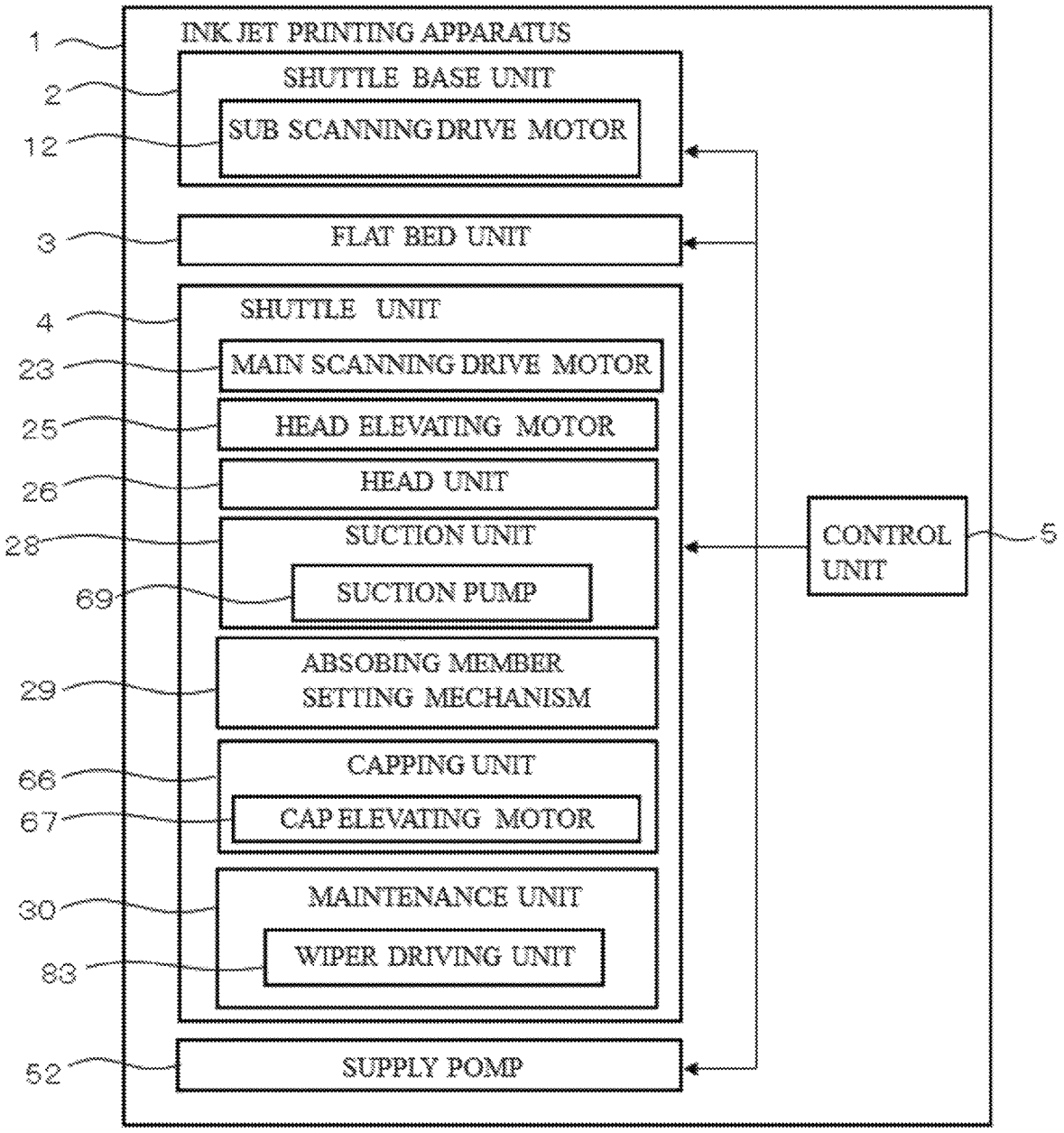
FIG. 9 is a block diagram that illustrates a control system of the ink jet printing apparatus illustrated in FIG. 1.

The capping unit 66 is moved vertically in the up-down direction by a cap elevating motor 67 (refer to FIG. 9). More specifically, the capping unit 66 moves vertically between a contact position at which the peripheral wall 77 of the cap 71 contacts the nozzle guard 32 and a retracted position below the contact position.

Further, when removing ink which has entered the aforementioned gap 40 formed between the bottom plate 41 of the nozzle guard 32 and the ink ejection surface 36*a*, the capping unit 66 moves upward to the side of the ink jet head 31 in a state with the absorbing member 50 installed above the cap 71, and presses the absorbing member 50 onto the opening 46 of the nozzle guard 32.

Figure 6:
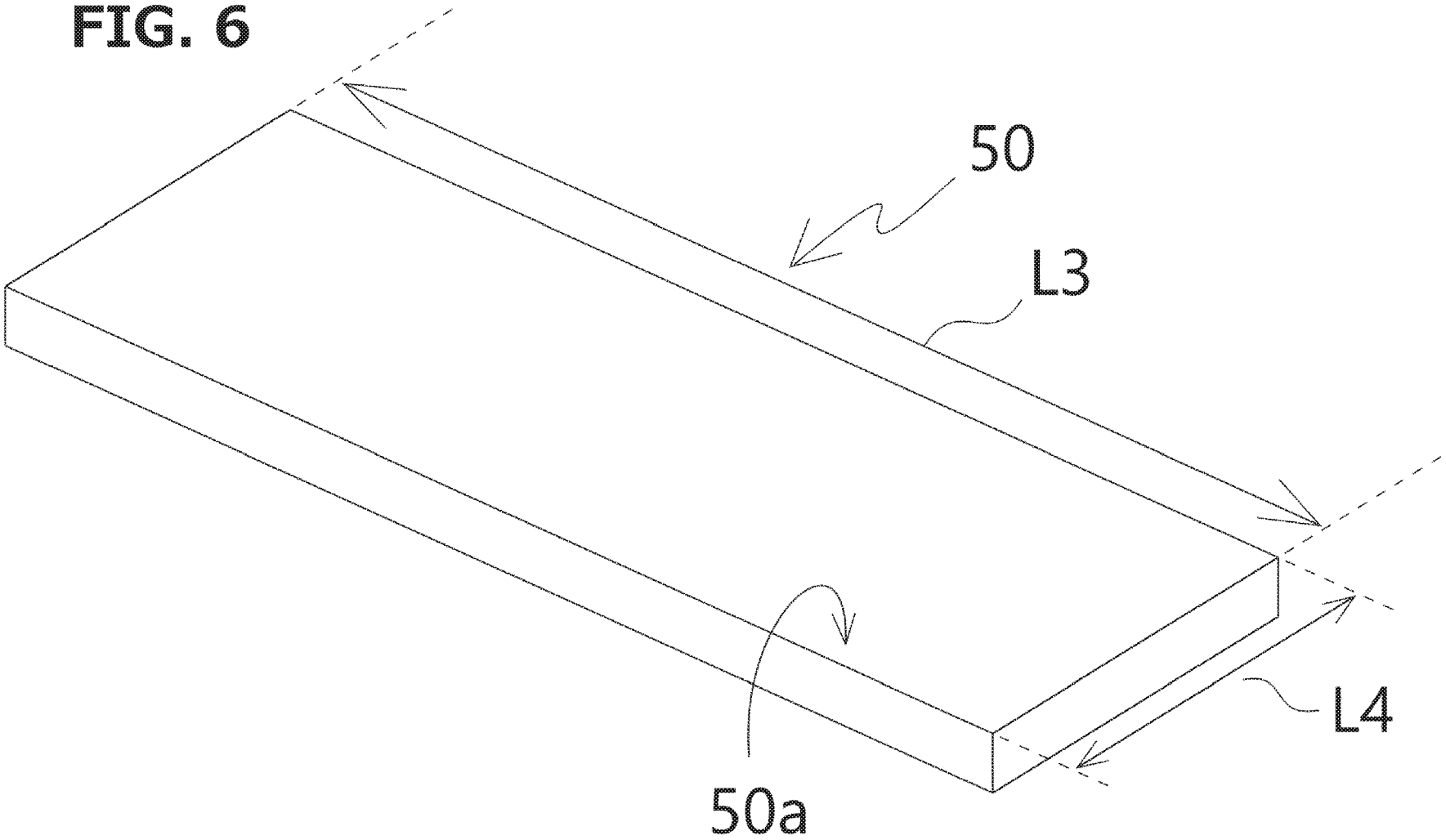
FIG. 6 is a diagram that illustrates an example of an absorbing member

The absorbing member 50 is a sheet shaped member having a size that covers the range of the opening 46 of the nozzle guard 32, and is a water absorbent member. FIG. 6 is a perspective view that illustrates the schematic configuration of the absorbing member 50. Specifically, the length L3 of the absorbing member 50 is greater than or equal to the length L1 of the opening 46 of the nozzle guard 32 illustrated in FIG. 3 in the front-back direction (the arrangement direction of the ink ejecting ports 37 of the nozzles), and the length L 4 is greater than or equal to the length L2 of the opening 46 of the nozzle guard 32 in the left-right direction (the direction orthogonal to the arrangement direction of the ink ejecting ports 37 of the nozzles). A surface 50*a* of the absorbing member 50 illustrated in FIG. 6 is pressed onto the opening of the nozzle guard 32.

The material of the absorbing member 50 may be any material as long as it can absorb ink, but it is preferably a porous sheet. In the case that ink absorbed by the absorbing member 50 is suctioned by the suction unit 28, it is preferable for the porous sheet to be that having continuous open cells as in the present embodiment. By employing a porous sheet having continuous open cells, suction of ink by the suction unit 28 can be conducted smoothly. Further, a printing sheet having porosity may be employed as the absorbing member 50.

In the present embodiment, the absorbing member 50 is provided between each ink jet head 31 and each capping unit 66, which is provided corresponding to each ink jet head 31.

The absorbing member setting mechanism 29 is a mechanism for inserting and removing the absorbing member 50 between each ink jet head 31 and each capping unit 66, which is provided corresponding to each ink jet head 31. Specifically, the absorbing member setting mechanism 29 moves the absorbing member 50 between a cleaning position (the position illustrated in FIG. 2), in which the absorbing member 50 is inserted between the ink jet head 31 and the capping unit 66, and a retracted position, in which the absorbing member 50 is withdrawn from between ink jet head 31 and the capping unit 66. The absorbing member setting mechanism 29 is configured by employing a known actuator or the like.

The suction unit 28 suctions ink which is absorbed by the absorbing member 50. As illustrated in FIG. 2, the suction unit 28 is provided under the capping unit 66. The suction unit 28 is equipped with four suction pipes 68, four suction pumps 69, and a waste liquid tank 70.

One end of each of the four suction pipes 68 is connected to one of the suction apertures 78 which are formed in the bottom portion 76 of each of the four caps 71, and the other ends of the four suction pipes 68 are connected to the waste liquid tank 70. A suction pump 69 is provided for each suction tube 68.

Ink which is absorbed by the absorbing member 50 that is set on the four caps 71 flows into the suction apertures 78 of the respective caps 71 by suction of the suction pump 69 and is stored in the waste liquid tank 70 via each suction pipe 68.

Figure 7:
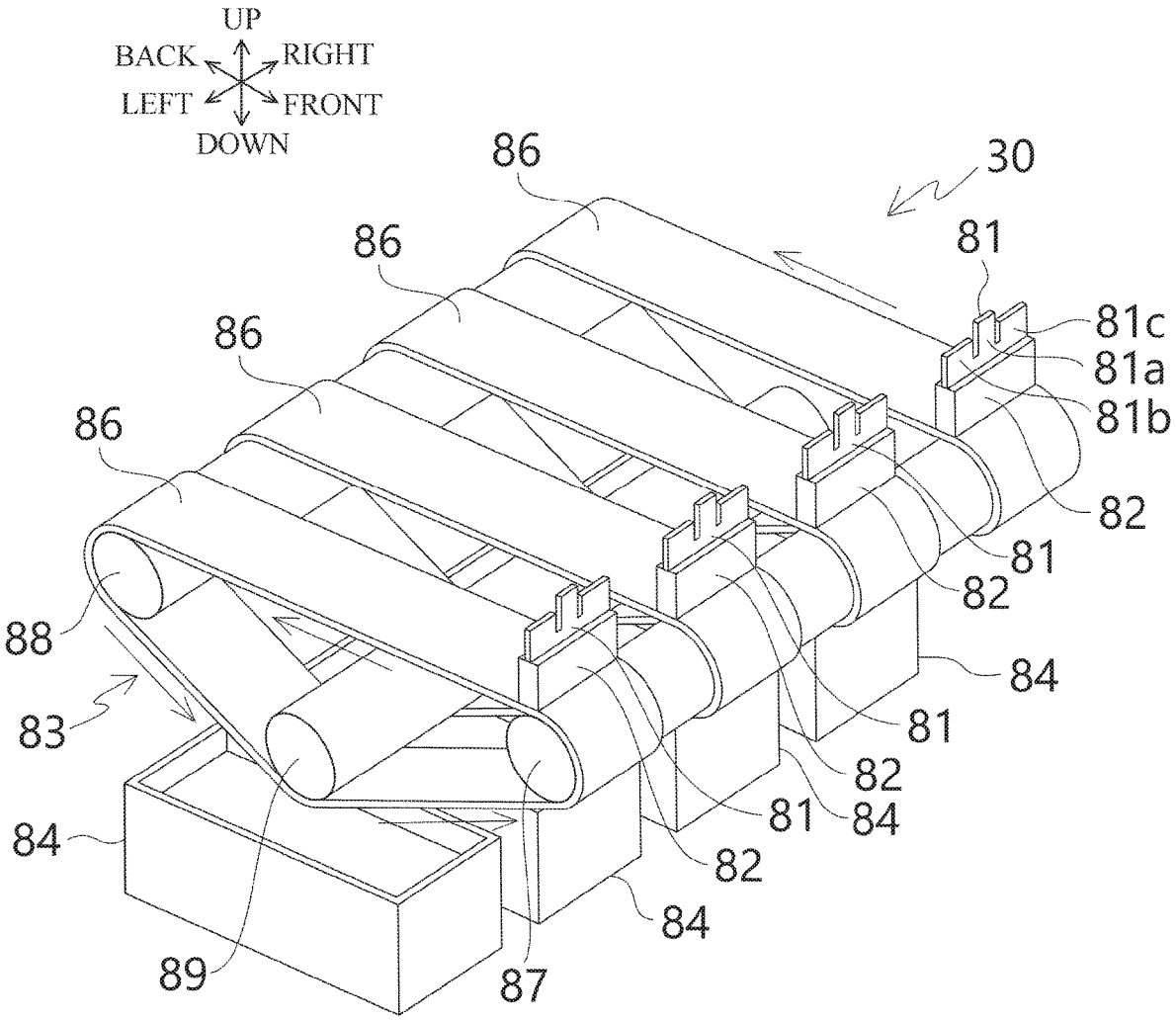
FIG. 7 is a diagram that illustrates the schematic configuration of a maintenance unit.

The maintenance unit 30 cleans the ink ejection surface 36*a* of the ink jet head 31 and the lower surface of the nozzle guard 32. The maintenance unit 30 is arranged inside the left end portion of the casing 21. As illustrated in FIG. 7, the maintenance unit 30 is equipped with four wipers 81, four wiper fixing sections 82, a wiper driving unit 83, and four cleansing tanks 84.

Each of the wipers 81 is a member that wipes the ink ejection surface 36*a* of the ink jet head 31 and the lower surface of the nozzle guard 32. The wipers 81 are made of a material such as elastically deformable rubber, and are formed in the shape of a plate. The sides of each of the wipers 81 toward the leading ends thereof may be divided into a central portion 81*a*, a left portion 81*b*, and a right portion 81*c*. The central portion 81*a* is a portion which is inserted into the opening 46 of the nozzle guard 32 and wipes the ink ejection surface 36*a* of the ink jet head 31. The leading end of the central portion 81*a* protrudes from the distal ends of the left side portion 81*b* and the right side portion 81*c*. The width (the length in the left-right direction) of the central portion 81*a* is slightly smaller than the width of the opening 46 of the nozzle guard 32. The left side portion 81*b* and the right side portion 81*c* are portions for wiping the lower surface of the nozzle guard 32.

The wiper fixing sections 82 fix the wipers 81 to wiper driving belts 86 to be described later.

The wiper driving unit 83 moves the wipers 81 in the arrangement direction of the ink ejecting ports 37 of the nozzles of the ink jet head 31. The wiper driving unit 83 is equipped with four wiper drive belts 86, a drive roller 87, and driven rollers 88, 89.

Each of the wiper drive belt 86 is an annular belt wrapped around the drive roller 87 and the driven rollers 88, 89. One of the wipers 81 is attached to each wiper drive belt 86 via one of the wiper fixing portions 82. The wiper drive belt 86 moves the wiper 81 by rotating in the direction indicated by the arrow illustrated in FIG. 7 (the counterclockwise direction as viewed from the left side). Thereby, the wipers 81 wipe the ink ejection surface 36*a* and the lower surface of the nozzle guard 32, while moving from the front side to the rear side in a horizontal section of the wiper driving belts 86 which are stretched between the driving roller 87 and the driven roller 88.

The driving roller 87 is rotationally driven by a motor (not shown), thereby rotating the wiper driving belt 86. The driven rollers 88, 89 support the four wiper drive belts 86 together with the drive roller 87. The driven rollers 88, 89 are driven to rotate by the drive roller 87 via the wiper drive belts 86. The driven roller 88 is arranged at the same height as the driving roller 87 and behind the driving roller 87. The driven roller 89 is disposed below an intermediate position between the driving roller 87 and the driven roller 88 in the front-back direction.

The cleansing tanks 84 store cleansing liquid. The cleansing tanks 84 are disposed below the wiper driving belt 86. Thereby, when the wipers 81 pass through the vicinity of the driven roller 89 due to the rotation of the wiper driving belts 86, the wipers 81 are immersed in the cleaning liquid in the cleansing tanks 84, and the cleansing liquid adheres to the wiper 81.

The cleaning liquid is a liquid that dissolves adhered substances (including ink components and flakes and powder on the surface of the print medium) adhered to the ink ejection surface 36*a* and the surface of the nozzle guard 32. It is preferable for an aqueous solvent containing water and a surfactant to be employed as the cleansing liquid. Examples of the surfactant include anionic surfactants such as sodium fatty acid, sodium alkylbenzenesulfonate, sodium alkylsulfonate, sodium α-olefin sulfonate, sodium alkylsulfate, sodium alkyl ether sulfate, sodium α-sulfo fatty acid ester, sodium alkylphosphate ester; cationic surfactants such as alkyltrimethylammonium and dialkyldimethylammonium; nonionic surfactants such as sorbitan fatty acid ester, polyoxyethylene sorbitan fatty acid ester, sucrose fatty acid ester, polyoxyethylene alkyl ether, polyoxyethylene alkyl phenyl ether, and amphoteric surfactants such as alkyl amino fatty acid sodium, alkyl betaine, and alkylamine oxide. Further, polymeric surfactants, silicone surfactants, fluorine surfactants, acetylene glycol surfactants, etc. may be employed. Among these, it is preferable for polyoxyethylene alkyl ether to be employed, and it is more preferable for the HLB value thereof to be 11 to 17, the number of carbon atoms of the alkyl group to be within a range from 8 to 15, and the number of moles of ethylene oxide added to be within a range from 6 to 25.

Further, it is preferable for the cleansing liquid to further contain a thickener. A water soluble polymeric thickener or a clay mineral based thickener may be employed as the thickener. Natural polymers, semisynthetic polymers, synthetic polymers may be employed as the water soluble polymeric thickener. Examples of natural polymers include natural plant polymers such as gum arabic, carrageenan, guar gum, locust bean gum, pectin, tragacanth gum, cornstarch, konjak mannan, agar; natural microbial polymers such as pullulan, xanthan gum and dextrin; and natural animal polymers such as gelatin, casein, glue. Examples of semisynthetic polymers include cellulose semisynthetic polymers such as ethylcellulose, carboxymethylcellulose, hydroxyethylcellulose, hydroxypropylcellulose, methylcellulose, and hydroxypropylmethylcellulose; starch series polymers such as hydroxyethylstarch, carboxymethylstarch sodium, and cyclodextrin; alginic acid based semisynthetic polymers such as sodium alginate and propylene glycol alginate; and sodium hyaluronate. Examples of synthetic polymers include vinyl synthetic polymers such as polyvinyl pyrrolidone, polyvinyl alcohol, polyvinyl methyl ether, poly N-vinyl acetamide, and polyacrylamide; polyethylene oxide, polyethylene imine, and polyurethane. Examples of the clay mineral based thickener include smectite clay minerals such as montmorillonite, hectorite, and saponite. Among these, it is preferable for hydroxypropyl methyl cellulose to be employed.

In addition to the above components, the cleansing liquid may optionally contain a water soluble organic solvent, a pH adjusting agent, an antioxidant, a preservative, etc., as appropriate. It is preferable for the viscosity of the cleansing liquid is preferably within a range from 5 to 200 mPa·s at 23° C., and more preferably a range from 10 to 100 mPa·s.

Figure 8:
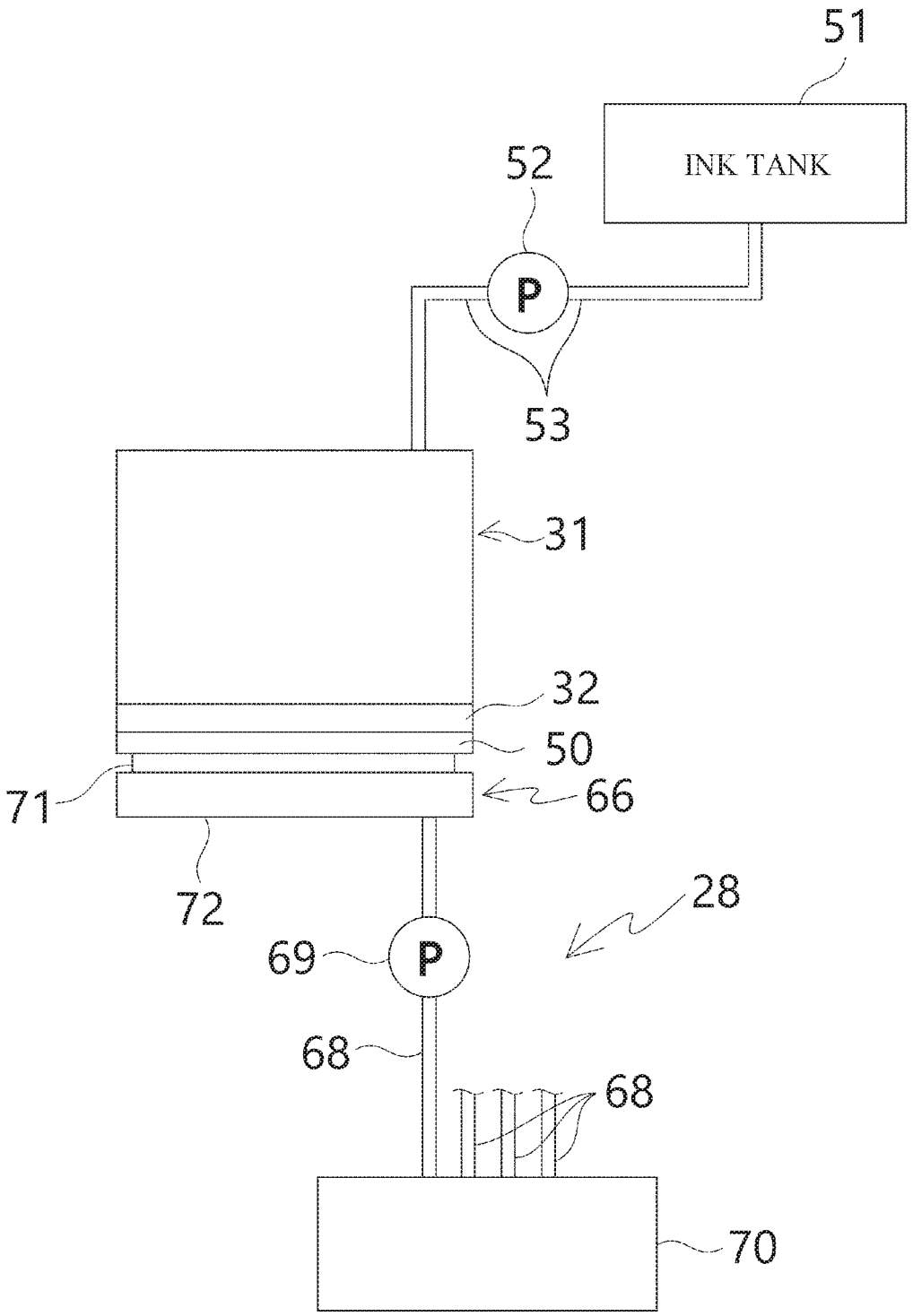
FIG. 8 is a diagram that illustrates the schematic configuration of an ink supply system and an ink suction system for an ink jet head.

As illustrated in FIG. 2, one end of an ink supply pipe 53 is connected to each of the ink jet heads 31. As illustrated in FIG. 8, an ink tank 51 that stores ink is connected to the other end of the ink supply pipe 53. A supply pump 52 is provided in the ink supply pipe 53. By operating the supply pump 52, the ink which is stored in the ink tank 51 is supplied to the ink jet head 31*s* via the ink supply pipe 53.

In the present embodiment, in a state in which the absorbing member 50 is pressed onto the opening 46 of the nozzle guard 32 of the ink jet head 31 as illustrated in FIG. 8, ink is supplied to the ink jet head 31 by the supply pump 52, and purging is performed. At this time, the purging operation and the ink removing operation by the absorbing member 50 are performed in parallel by suction being conducted by the suction pump 69. The purging operation and ink removing operation will be described in detail later.

FIG. 9 is a block diagram showing a control system of the ink jet printing apparatus 1 of the present embodiment. The ink jet printing apparatus 1 is equipped with a control unit 5 that controls the entire apparatus. The control unit 5 is equipped with a CPU (Central Processing Unit), a semiconductor memory, a hard disk, etc. The control unit 5 executes a program which is stored in advance in a storage medium such as a semiconductor memory or a hard disk, and operates an electric circuit to control each of the components illustrated in FIG. 9.

Next, a printing operation of the ink jet printing apparatus 1 of the present embodiment will be described.

When the ink jet printing apparatus 1 is in a standby state before a printing operation is initiated, the shuttle unit 4 is disposed at a standby position. The standby position of the shuttle unit 4 is the position of the shuttle unit 4 indicated by the solid line in FIG. 1 and is at the back end of the gantry section 11 of the shuttle base unit 2.

When a print job is input, the control unit 5 controls the sub scanning drive motor 12 to move the shuttle unit 4 from the standby position to a print processing start position. The printing process starting position of the shuttle unit 4 is the position of the shuttle unit 4 indicated by the two dot chain line in FIG. 1, and is at the front end portion of the gantry section 11 of the shuttle base unit 2. A print medium 15 is installed on the medium placement surface 3*a* of the flat bed unit 3 prior to the print job being input.

Next, while controlling the main scanning drive motor 23 to move the head unit 26 in the main scanning direction, the control unit 5 controls the ink jet heads 31 based on the inputted print job to control the ink ejecting ports 37 such that printing for one pass is performed. Next, the control unit 5 controls the sub scanning drive motor 12 to move the shuttle unit 4 backward to the printing position for a next pass. The control unit 5 forms an image on the print medium 15 by alternately repeating the printing for one pass and the movement of the shuttle unit 4.

When printing of one sheet is completed, the control section 5 controls the sub scanning drive motor 12 to return the shuttle unit 4 to the standby position. Then, the printing operation is completed.

Next, a maintenance operation which is performed by the ink jet printing apparatus 1 of the present embodiment will be described with reference to FIGS. 10 and 11. The maintenance operation of the present embodiment is an operation for removing ink which has entered the gap 40 between the nozzle guard 32 and the ink ejection surface 36*a* and for forming a meniscus at the ink ejecting port 37 of each of the nozzles.

Figure 10A:
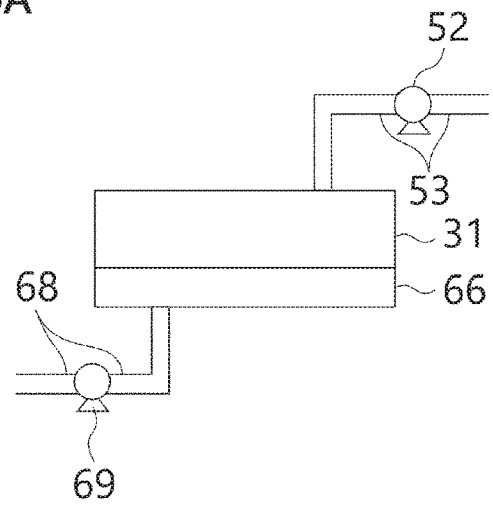
FIG. 10A is a diagram for explaining a maintenance operation performed by one embodiment of the ink jet printing apparatus of the present invention.

The maintenance operation is performed when the shuttle unit 4 is placed at the standby position. At this time, the head unit 26 in the shuttle unit 4 is disposed at the standby position shown in FIG. 2. Then, the capping unit 66 is in a state in which it is abutting each of the ink jet heads 31 of the head unit 26, which is arranged at the standby position as illustrated in FIG. 10A, that is, the opening 46 of the nozzle guard 32 of each of the ink jet heads 31 is hermetically sealed by one of the caps 71 of the capping unit 66.

Figure 10B:
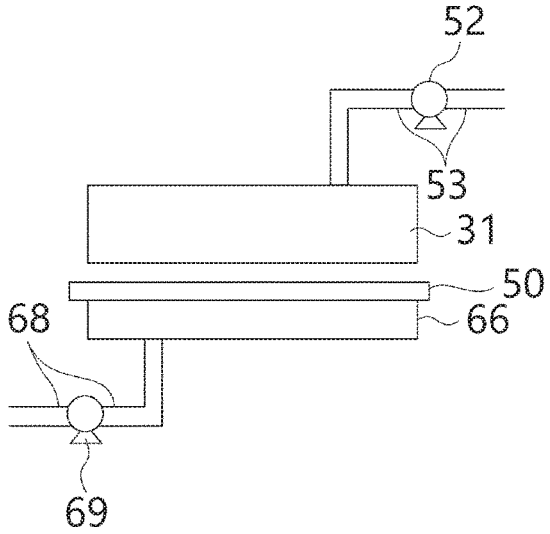
FIG. 10B is a diagram for explaining a maintenance operation performed by one embodiment of the ink jet printing apparatus of the present invention.

When the maintenance operation is initiated, first, the cap elevating motor 67 is controlled by the control unit 5 such that the capping unit 66 is lowered and is disposed at the retracted position. Then, the absorbing member setting mechanism 29 is controlled by the control unit 5, and the absorbing member 50 is disposed on the caps 71 of the capping unit 66, as illustrated in FIG. 10B.

Figure 10C:
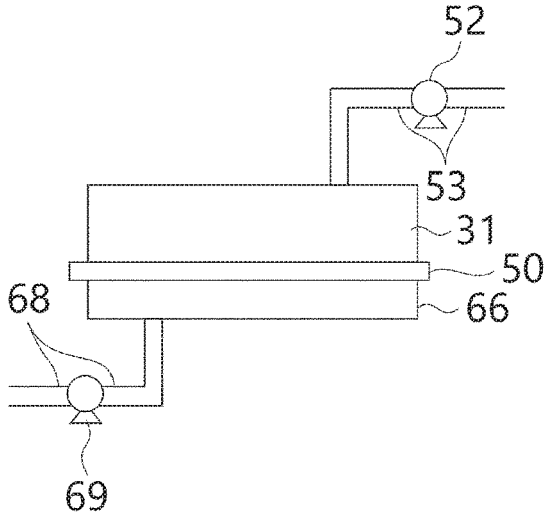
FIG. 10C is a diagram for explaining a maintenance operation performed by one embodiment of the ink jet printing apparatus of the present invention.

Next, the cap elevating motor 67 is controlled by the control unit 5 to raise the capping unit 66, and the absorbing member 50 is brought into a state in which it is being pressed onto the opening 46 of the ink jet head 31, as illustrated in FIG. 10C.

Figure 11A:
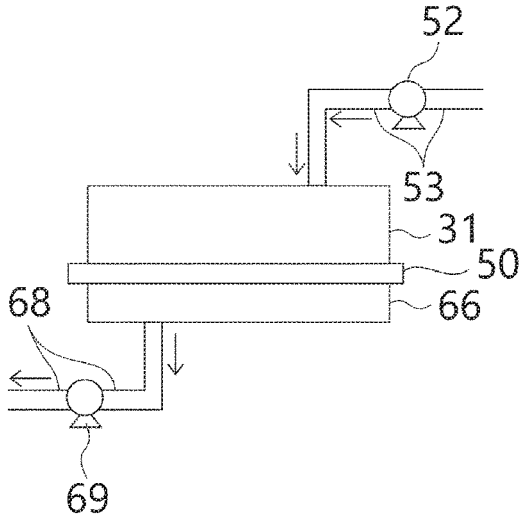
FIG. 11A is a diagram for explaining a maintenance operation performed by one embodiment of the ink jet printing apparatus of the present invention.
Figure 11B:
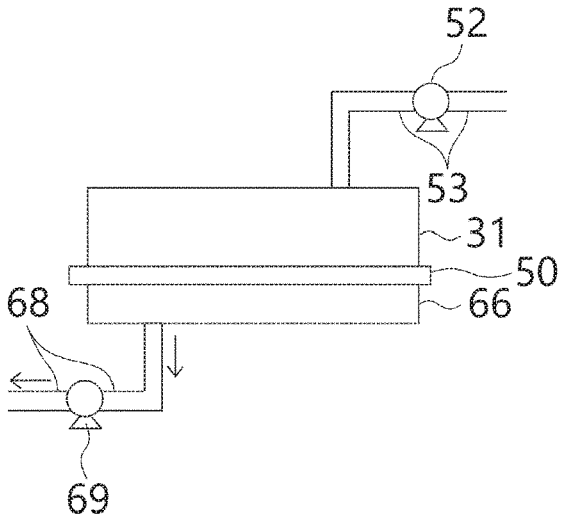
FIG. 11B is a diagram for explaining a maintenance operation performed by one embodiment of the ink jet printing apparatus of the present invention.

Thereafter, the supply pump 52 is controlled by the control unit 5, and as indicated by the arrows illustrated in FIG. 11A, ink is supplied to each ink jet head 31 and pressurized to perform the purging operation. In parallel with this purging operation, the suction pump 69 is controlled by the control unit 5, and suction is conducted by the suction pump 69. By conducting the purging and the suction in parallel as described above, the ink which has entered the gap 40 between the nozzle guard 32 and the ink ejection surface 36*a* is absorbed and removed by the absorbing member 50. In parallel with the removal of the ink in the gap 40, a meniscus is formed at the ink ejecting port 37 of each nozzle of the ink jet head 31.

At this time, the control unit 5 sets the pressurizing conditions of the supply pump 52 and the suction conditions of the suction pump 69 to those that enable the ink within the gap 40 to be removed and the meniscus which is formed at the ink ejecting port 37 of each nozzle to be maintained. Specifically, the rotational speed of the supply pump 52 is set to 100 rpm and the supply pump is driven for 10 seconds as the pressurizing conditions of the supply pump 52, for example. In addition, the rotational speed of the suction pump 69 is set to be within a range from 90 rpm to 150 rpm, and the suction pump 69 is driven for 30 seconds. WPX1-P3.2FA4-W6-CP by Welco are employed as the supply pump 52 and the suction pump 69, respectively.

After a 10 second purging operation by pressurization by the supply pump 52 and suctioning by the suction pump 69 is complete, the suction by the suction pump 69 is continued for 20 seconds (30 seconds minus 10 seconds), as described above (refer to FIG. 11B). Thereby, the ink absorbed by the absorbing member 50 is suctioned toward the side of the capping unit 66, flows to the suction apertures 78 which are formed in the bottom portions 76 of the cap 71, and is stored in the waste liquid tank 70 via the suction pipe 68. By continuing suctioning by the suction pump 69 after the purging operation is completed in this manner, the ink which is absorbed by the absorbing member 50 can be recovered. As a result, the absorbing member 50 can be reused.

Figure 11C:
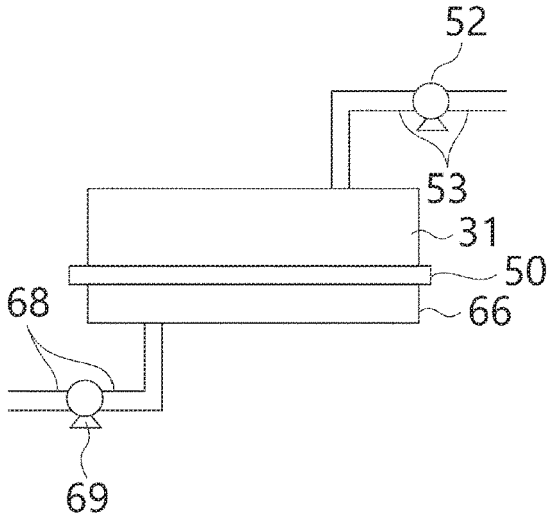
FIG. 11C is a diagram for explaining a maintenance operation performed by one embodiment of the ink jet printing apparatus of the present invention.

After suction is conducted by the suction pump 69 for a predetermined amount of time, the suction pump 69 is stopped, as illustrated in FIG. 11C.

The above is the explanation of the maintenance operation of the present embodiment.

Note that in the case that a printing process is performed after the maintenance operation, the capping unit 66 descends, the absorbing member 50 is removed from the cap 71 and is moved to the retracted position, the head unit 26 is raised by the head elevating motor 25 to move to a predetermined position, and then moves in the left-right direction along the main scanning drive guide 22 to perform the printing process.

In the maintenance operation of the present embodiment, it is not necessary to provide a separate mechanism for pressing the absorbing member 50, because the absorbing member 50 is pressed onto the opening 46 of the nozzle guard 32 employing the capping unit 66. Accordingly, miniaturization of the apparatus can be achieved.

In addition, it is not necessary to secure time for the ink removing operation separate from the purging operation because the ink removing operation to remove ink from the gap 40 between the nozzle guard 32 and the ink ejection surface 36*a* and the purging operation are conducted in parallel. Accordingly, printing processes can be initiated immediately.

Further, even in the case that the ink jet heads 31 are moved, it is possible to suppress ejection failure caused by the movement of the ink jet heads 31.

Note that in the case that a printing process is not performed following the maintenance operation, the capping unit 66 descends, the absorbing member 50 is removed from the cap 71 and is moved to the retracted position, and then the capping unit 66 is raised again to be in a state in which the capping unit 66 abuts the ink jet heads 31, as illustrated in FIG. 10A.

The maintenance operation may be performed automatically immediately prior to initiating a printing process, or may be performed according to a command which is input by a user. As a further alternative, the maintenance operation may be performed at every preset period or each time after a preset number of sheets is printed.

In the present embodiment, when the maintenance operation is performed, the capping unit 66 is moved toward the ink jet head 31 such that the absorbing member 50 is pressed onto the opening 46 of the ink jet heads 31. However, the present invention is not limited to this configuration. The ink jet heads 31 may be moved toward the side of the capping unit 66 such that the absorbing member 50 is pressed onto the opening 46 of the ink jet heads 31. Alternatively, the absorbing member 50 may be pressed onto the opening 46 of the ink jet heads 31 by moving both the ink jet heads 31 and the capping unit 66 towards each other.

Next, a wipe cleaning operation in the ink jet printing apparatus 1 of the present embodiment will be described. The wipe cleaning operation of the present embodiment is an operation that removes ink, dust, etc. which are adhered to the ink ejection surface 36*a* and the lower surface of the nozzle guard 32.

When performing out the wipe cleaning operation, first, the control unit 5 controls the wiper driving unit 83 to causes the wipers 81 to move and pass through the cleansing tank 84, thereby cleaning the wiper 81 and causing the cleaning liquid to adhere to the wipers 81.

Next, after releasing the capping of the opening 46 of the nozzle guard 32 by the capping unit 66, the control unit 5 controls the main scanning drive motor 23 to move the head units 26 from a home position to a position above the maintenance unit 30. Thereafter, the control unit 5 controls the head elevating motor 25 to lower the head unit 26 to a cleaning position. The cleaning position of the head unit 26 is the position at which the wipers 81 wipe the ink ejection surface 36*a* of the head units 26.

When the movement of the head unit 26 to the cleaning position is completed, the wipers 81 are arranged at the front side of the front end of the nozzle guard 32. Further, the leading ends (upper end) of the central portions 81*a* of the wipers 81 are higher than the ink ejection surface 36*a*, and the left side portions 81*b* and the right side portions 81*c* of the wipers 81 are higher than the lower surface of the nozzle guard 32.

Next, the control unit 5 causes the wiper driving unit 83 to initiate movement of the wipers 81. When the wipers 81 move backward and come into contact with the nozzle guard 32, the wipers 81 are pressed by the nozzle guard 32 and are elastically deformed. Then, along with the backward movement, the upper end portions of the center portions 81*a*, the left side portions 81*b*, and the right side portions 81*c* of the wipers 81 slide along the lower surface of the nozzle guard 32 and perform wiping. Thereby, ink and dirt which are adhered to the lower surface of the nozzle guard 32 are wiped off by the wipers 81.

When the wipers 81 reach the front end of the opening 46 of the nozzle guard 32, the central portions 81*a* of the wipers 81 are inserted into the opening 46. Thereafter, the leading end portions of the central portions 81*a* of the wipers 81 wipe the ink ejection surface 36*a*. Thereby, ink and dirt which are adhered to the ink ejection surface 36*a* are wiped off.

When the wipers 81 reach the rear end of the opening 46 of the nozzle guard 32, the central portions 81*a* of the wipers 81 exit the opening 46. Thereafter, the upper end portions of the central portions 81*a*, the left side portions 81*b*, and the right side portions 81*c* of the wipers 81 wipe the lower surface of the nozzle guard 32. When the wipers 81 reach the back side of the nozzle guard 32 from the back end thereof, the control unit 5 terminates the movement of the wiper 81. Thereby, the wipe cleaning operation is completed.

When the wipe cleaning operation is completed, the control unit 5 returns the head unit 26 from the cleaning position to the home position, and caps the opening 46 of the nozzle guard 32 with the capping unit 66.

Note that the wipe cleaning operation may be performed automatically immediately before initiating a printing process or may be performed according to a command which is input by a user. As a further alternative, the wipe cleaning operation may be performed every preset period or each time after a preset number of sheets is printed.

In addition, the ink jet printing apparatus 1 of the embodiment described above, the absorbing member 50 is disposed on the cap 71 of the capping unit 66. Alternatively, a sheet shaped elastic member 54 may be provided between the caps 71 of the capping unit 66 and the absorbing member 50, and the maintenance operation described above may be performed. When performing the maintenance operation, the elastic member 54 may be set on the caps 71 of the capping unit 66 by employing a predetermined setting mechanism (not shown).

A sponge cloth, a silicon sheet, a rubber sheet, etc. may be employed as the elastic member 54, for example. Note that in the case that a member that does not allow air to pass therethrough such as a silicon sheet, a rubber sheet or the like is employed as the elastic member 54, the aforementioned suction operation can be appropriately performed if a plurality of penetrating apertures are formed in the elastic member 54.

By providing the elastic member 54 between the cap 71 and the absorbing member 50, when the absorbing member 50 is pressed onto the opening 46 of the nozzle guard 32 of the ink jet head 31, close contact properties between the absorbing member 50 and the nozzle guard 32 can be improved. As a result, it will become possible to uniformly remove ink that seeps out from the gap 40 between the ink ejection surface 36*a* and the nozzle guard 32.

In the ink jet printing apparatus 1 of the embodiment described above, the absorbing member 50 is pressed onto the opening 46 of the nozzle guard 32 by employing the capping unit 66. Alternatively, it is also possible to provide a pressing mechanism within the shuttle unit 4 separate from the capping unit 66, and the absorbing member 50 may be pressed onto the opening 46 of the nozzle guard 32 employing the pressing mechanism.

Figure 13:
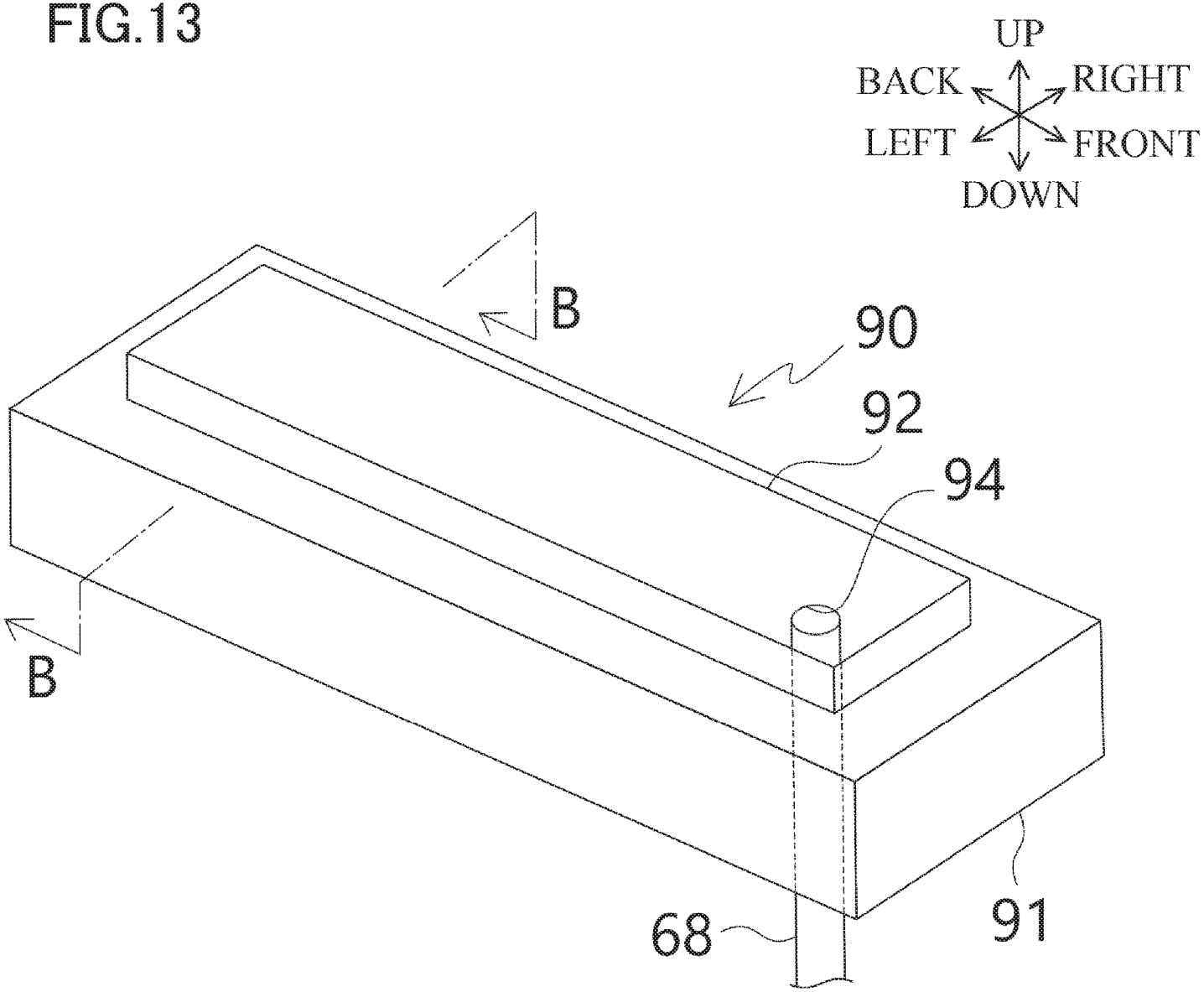
FIG. 13 is a diagram that illustrates the schematic configuration of another embodiment of a pressing mechanism of the present invention.

FIG. 13 is a diagram that illustrates an example of a pressing member 90 separate from the capping unit 66. The pressing member 90 is provided with the absorbing member 50 in the same manner as the caps 71 of the capping unit 66. During the maintenance operation, the pressing member 90 is moved to the side of the ink jet head 31 by a predetermined elevating mechanism (not shown), and the absorbing member 50 is pressed onto the opening 46 of the nozzle guard 32.

Figure 14:
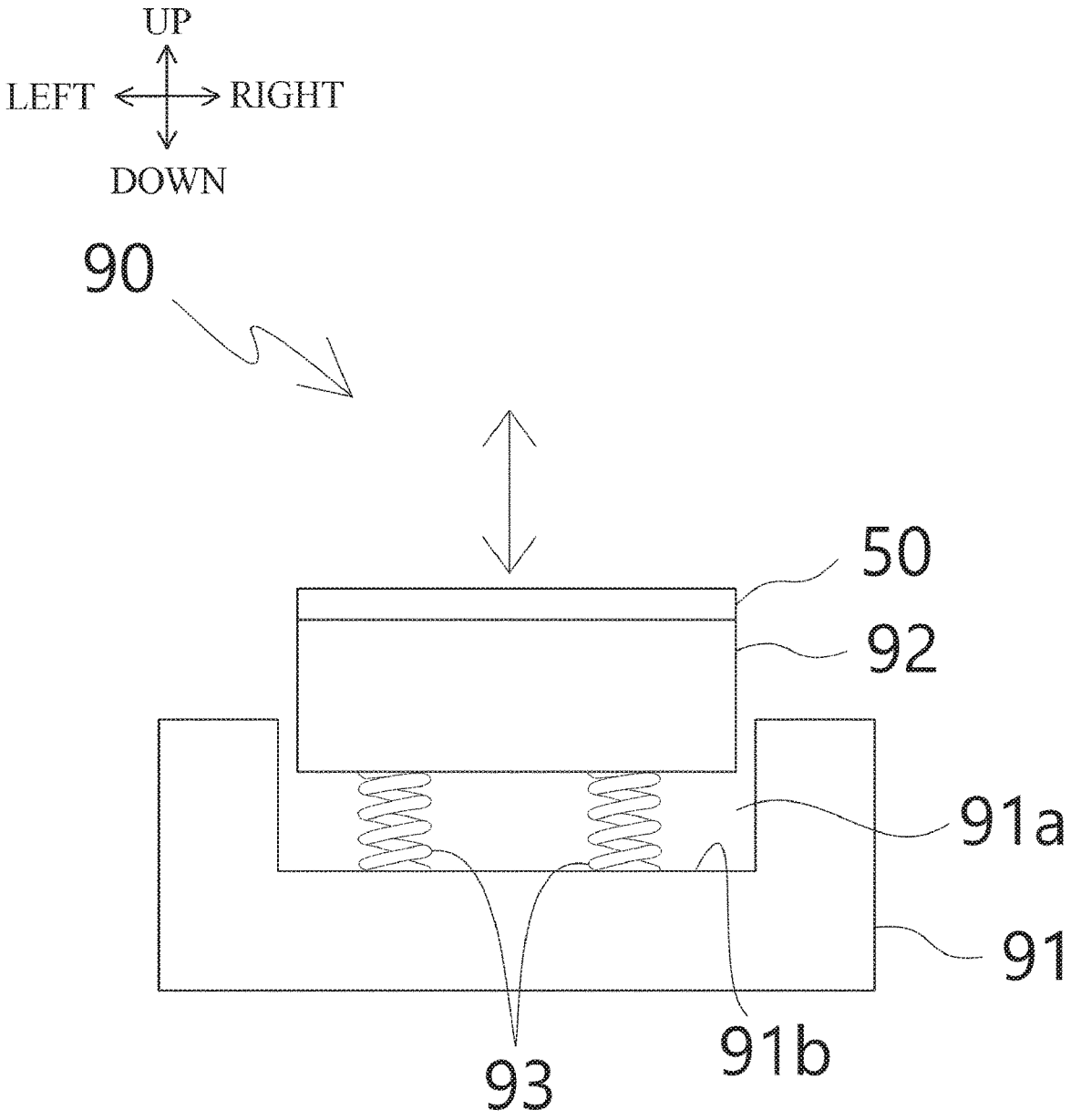
FIG. 14 is a cross sectional view of the pressing member illustrated in FIG. 13 taken along line B-B.

FIG. 14 is a cross sectional view of the pressing member 90 taken along the line B-B of FIG. 13. As illustrated in FIGS. 13 and 14, the pressing member 90 is equipped with a base 91, an installation base 92, and a plurality of spring members 93. The base 91 is a member made of a rectangular parallelepiped resin, in which a rectangular parallelepiped shaped recess 91*a* is formed. The installation base 92 is a member made of rectangular parallelepiped resin, and is installed in the recess 91*a* of the base 91.

The spring members 93 are installed together with the installation base 92 in the recess 91*a* of the base 91. One of the ends of the spring members 93 are connected to a bottom surface 91*b* of the recess 91*a*, and the other of the ends are connected to the lower surface of the installation base 92. The spring members 93 urge the installation base 92 upward. The installation base 92 moves in the direction of the arrow (up-down direction) illustrated in FIG. 14 by elastic force imparted by the spring member 93. Although only two spring members 93 are illustrated in FIG. 14, it is preferable for the spring members 93 to be provided at the four corners on the lower surface of the installation base 92 or in a uniformly distributed manner with respect to the lower surface of the installation base 92.

As illustrated in FIG. 14, when the absorbing member 50 is installed on the installation base 92, the pressing member 90 moves toward the side of the ink jet heads 31 and is pressed onto the nozzle guard 32 of the ink jet head 31, the spring members 93 cause the upper surface of the installation base 92 to move flexibly. Thereby, the close contact properties between the absorbing member 50 and the nozzle guard 32 can be improved, and ink that seeps out from the gap 40 between the ink ejection surface 36*a* and the nozzle guard 32 can be uniformly removed.

Suction apertures 94 which are connected to the suction pipes 68 are formed in the pressing member 90 in the same manner as in the capping unit 66.

Further, the pressing member 90 illustrated in FIGS. 13 and 14 employs the spring members 93. Alternatively, other elastic members such as rubber members may be employed.

Figure 12:
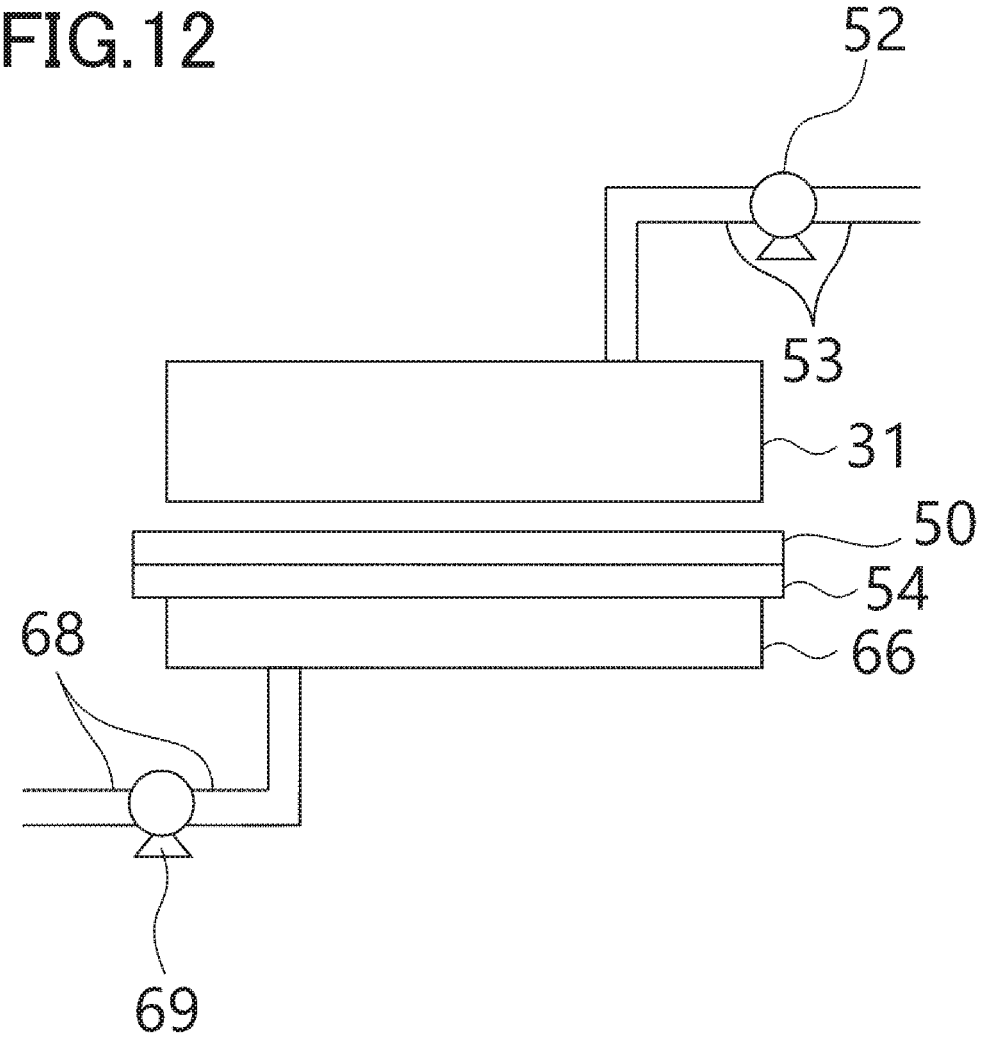
FIG. 12 is a diagram that illustrates an example in which an elastic member is provided between a capping unit and an absorbing member.

Further, as illustrated in FIG. 12, a sheet shaped elastic member such as a sponge cloth may be provided between the installation base 92 of the pressing member 90 and the absorbing member 50.

In the case that the absorbing member 50 is pressed onto the nozzle guard 32 by the capping unit 66, a spring member may be provided such that the caps 71 can move in the up-down direction in the same manner as the pressing member 90 described above.

Further, it is preferable for the absorbing member 50 to contain a liquid having solubility with respect to dried ink. By the absorbing member 50 containing such a liquid, it will become possible to appropriately remove ink which has seeped out from the gap 40 between the ink ejection surface 36*a* and the nozzle guard 32 and has dried. It is preferable for a liquid which is the same as the cleansing liquid described above to be employed as the liquid having solubility with respect to dried ink. Further, an absorbing member 50 that contains the liquid in advance may be employed, or a tank for storing the liquid may be provided, and a mechanical mechanism that immerses the absorbing member 50 in the tank, and then arranges the absorbing member 50 on the caps 71 of the capping unit 66 or the installation base 92 of the pressing member 90 may be provided in the shuttle unit 4

In addition, in the above embodiment, purging is performed in a state in which the absorbing member 50 is pressed against the opening 46 of the inkjet head 31. At the same time, suctioning by the suction pump 69 causes the ink which has entered the gaps between the nozzle guard 32 and the ink ejecting surfaces 36*a* to be absorbed by the absorbing member 50 and forms a meniscus at the ink ejection port 37 of each of the nozzles. However, the method by which the maintenance operation is performed is not limited to this, and other methods may be applied. Hereinafter, another embodiment of the maintenance operation will be described with reference to FIG. 15 and FIG. 16.

First, in the previously described embodiment, the absorbing member 50 is pressed against the ink jet head 31 by the capping unit 66. However, in the other embodiment, a pressing base 100 is provided in the shuttle unit 4 in addition to the capping unit 66.

Then, by moving the pressing base 100 on which the absorbing member 50 is mounted toward the ink jet head 31, the absorbing member 50 is pressed against the ink jet head 31 at a predetermined pressure. The pressing base 100 is provided for each ink jet head 31, and is formed of a material such as resin having a certain degree of rigidity that does not deform by, for example, a pressing operation. However, an elastic sheet made of a sponge cloth, a silicone sheet or a rubber sheet may be provided on the pressing base 100 and the absorbing member 50 may be provided on the elastic sheet, in order to improve the close contact properties of the absorbing member 50 with respect to the nozzle guard 32.

Figure 15A:
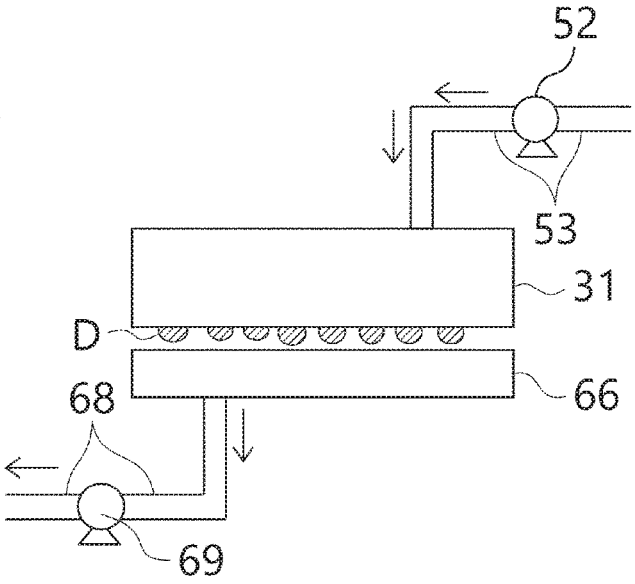
FIG. 15A is a collection of diagrams for explaining an alternate embodiment of the maintenance operation.

In the maintenance operation of the alternate embodiment, first, the supply pump 52 is controlled by the control unit 5 and purging is performed in a state where the ink jet head 31 is disposed above the capping unit 66, as illustrated in FIG. 15A. At the time of this purging operation, the opening 46 of the nozzle guard 32 of the ink jet head 31 may be hermetically sealed by the cap 71 of the capping unit 66, or the opening 46 may be an open state, as illustrated in FIG. 15A. In addition, the ink discharged from the ink jet head 31 by this purging operation is received by the capping unit 66, and suctioned from the capping unit 66 by the suction pump 69 being controlled by the control unit 5 to recover the ink. This purging operation results in a state in which ink droplets D are adhered to the ink discharge ports 37 of the ink jet head 31, as illustrated in FIG. 15A.

Figure 15B:
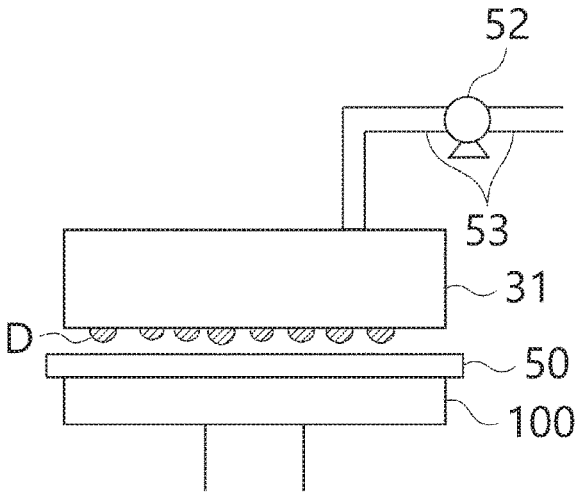
FIG. 15B is a collection of diagrams for explaining an alternate embodiment of the maintenance operation.

Next, the inkjet head 31 moves and is arranged above the pressing base 100, as illustrated in FIG. 15B. Then, the absorbing member setting mechanism is controlled by the control unit 5, and the absorbing member 50 is set on the pressing base 100. Note that the absorbing member setting mechanism is for setting the absorbing member 50 on the pressing base 100, and the specific configuration thereof is the same as that of the absorbing member setting mechanism 29 illustrated in FIG. 2 and FIG. 9.

Figure 15C:
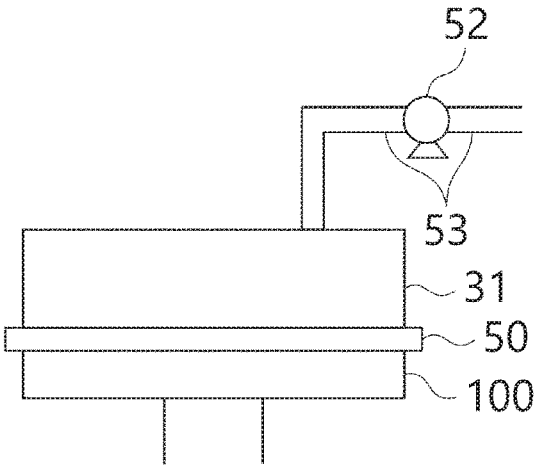
FIG. 15C is a collection of diagrams for explaining an alternate embodiment of the maintenance operation.

Next, a predetermined drive motor (not shown) is controlled by the control unit 5 to raise the pressing base 100, resulting in a state in which the absorbing member 50 is pressed against the opening 46 of the inkjet head 31, as illustrated in FIG. 15C.

Figure 16D:
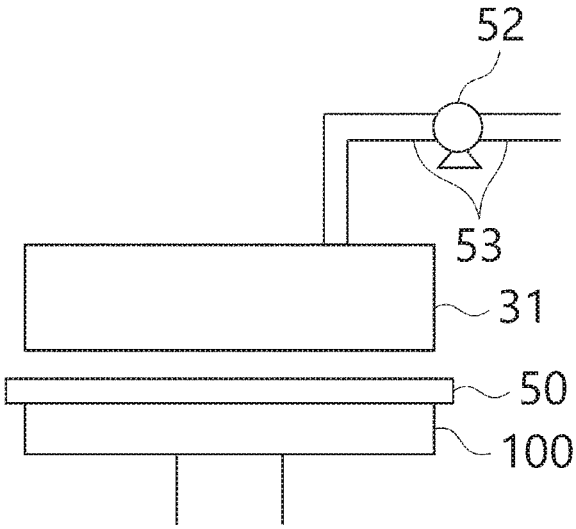
FIG. 16D is a collection of diagrams for explaining the alternate embodiment of the maintenance operation.

Then, after the absorbing member 50 is pressed against the opening 46 of the ink jet head 31 at a predetermined pressure for a predetermined amount of time, the driving motor is controlled by the control unit 5, causing the pressing base 100 to descend and move to a standby position, as illustrated in FIG. 16D.

Figure 16E:
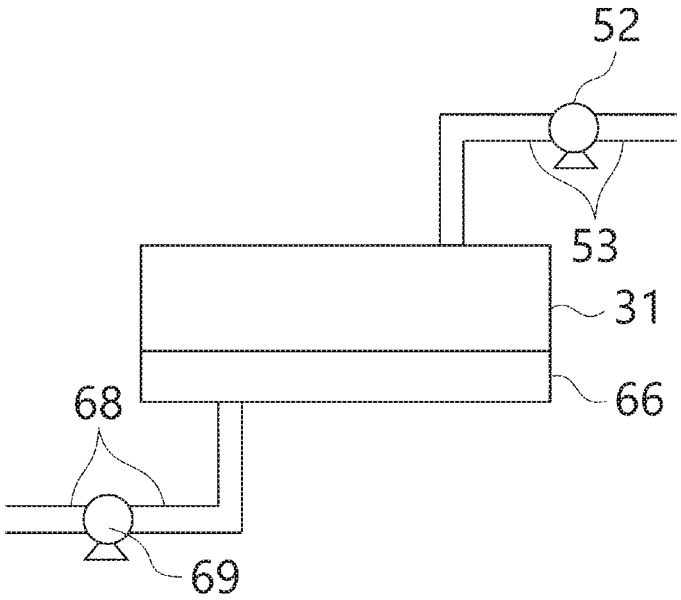
FIG. 16E is a collection of diagrams for explaining the alternate embodiment of the maintenance operation.

Thereafter, the inkjet head 31 moves and is placed on the capping unit 66 as illustrated in FIG. 16E. Then, the capping unit 66 ascends, abuts the inkjet head 31, and the opening 46 of the nozzle guard 32 of the inkjet head 31 is sealed. The above is a description of the alternate embodiment of the maintenance operation.

Here, similarly to the maintenance operation of the previously described embodiment, the maintenance operation of the alternate embodiment described above is an operation that removes the ink that has entered the gap 40 between the nozzle guard 32 and the ink ejection surface 36*a*, and forms a meniscus at the ink ejection port 37 of each of the nozzles.

In the maintenance operation according to the alternate embodiment, it is preferable for the absorbency and the surface roughness of the absorbing member 50 as well as the pressing pressure and the amount of time that the absorbing member 50 is pressed against the ink jet head 31 by the pressing base 100 to be set appropriately, in order to favorably remove the ink in the gap 40 and to maintain the meniscus formed at each of the nozzles.

Specifically, in the case that the absorbency of the absorbing member 50 is low, it is not possible to appropriately remove the ink in the gap 40 of the nozzle guard 32. Further, in the case that the fibers on the surface of the absorbing member 50 are fluffed, there may be cases in which the fibers enter the ink discharge ports 37 and break the meniscuses therein.

Figure 17:
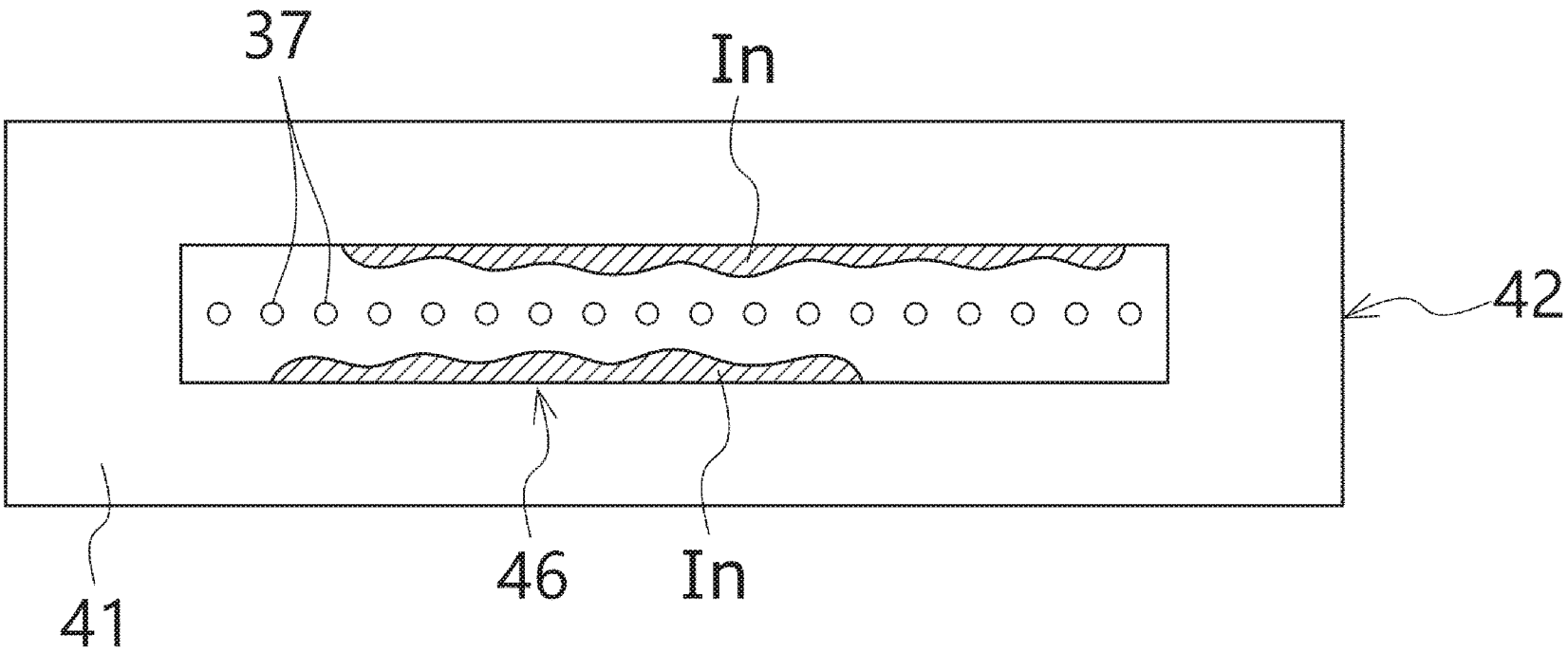
FIG. 17 is a diagram for explaining seepage of ink from gaps in a nozzle guard.

In addition, the greater the pressing pressure, the ink within the gap 40 of the nozzle guard 32 can be pressed outward to the exterior of the gap 40 and can be easily absorbed by the absorbing member 50. However, if the pressing pressure is excessively large, there may be cases in which the absorbing member 50 is pressed excessively strongly against the ink ejection ports 37 and the meniscuses therein are broken, resulting in ink ejection failure. In addition, there may be cases in which the ink that seeps out from the gap 40 of the nozzle guard 32 due to the pressing of the absorbing member 50 reaches the ink ejection port 37 before being absorbed by the absorbing member 32, blocking the ink ejection port 37, resulting in ink ejection failure. FIG. 17 is a diagram that illustrates an example of the state of the ink that seeps out from the gap 40 of the nozzle guard 32 by the pressing the absorbing member 50.

In addition, in the case that the pressing time is excessively short, it is not possible to sufficiently absorb the ink that seeps out from the gap 40. In the case that the pressing time is excessively long, there may be cases in which the meniscuses which are formed in the ink discharge ports 37 will be broken.

Taking these factors into consideration, it is preferable for an absorbing member having an absorbency of 10 mm/5 min or greater and 80 mm/5 min or less and a surface roughness Rz of 410 μm or less to be employed as the absorbing member 50. It is also preferable for the absorbing member 50 to be pressed against the ink jet head 31 with a pressing pressure of 10 kPa or greater and 80 kPa or less for an amount of time 7 seconds or greater and 60 seconds or less. By adopting such a configuration, it is possible to favorably remove the ink in the gap 40 of the nozzle guard 32 and appropriately maintain the meniscus which is formed in each of the nozzles.

Note that the bases for setting the absorbency and the surface roughness Rz of the absorbing member 50 as well as the numerical values of the pressing pressure and the pressing time of the absorbing member 50 will be shown by Examples and Comparative Examples, which will be described later.

In addition, it is preferable for the absorbing member 50 to be formed by fibers which are thicker than the diameter of the nozzles, in order to prevent the fibers of the absorbing member 50 from breaking the meniscuses which are formed in the ink discharge ports 37 as described above, By adopting such a configuration, it will become possible to prevent the meniscuses from being broken due to the fibers of the absorbing member 50 entering the ink ejection ports 37.

The thicknesses of the fibers of the absorbing member 50 are measured by observing the upper surface of the absorbing member 50 with an optical microscope "AZ-100M" by NIKON, and measuring the distance between two points with a measuring tool. Specifically, fibers that protrude from the upper surface of the compressed and flattened absorbent member 50 are designated as targets of measurement, two points that yield the largest diameter are specified, and the distance therebetween is measured. Then, the average value of the measurement results of ten fibers is designated as the thickness of the fibers of the absorbing member 50 as referred to here.

In addition, it is preferable for the lengths of the fiber on the surface of the absorbing member 50 to be shorter than the distance from the ink ejection surface 36*a* of the nozzles to the surface 32 of the nozzle guard (the surface that faces the ink ejection surface 36*a*; refer to FIG. 4). By adopting such a configuration, it will become possible to prevent the fibers of the absorbing member 50 from entering the ink discharge port 37, and it will become possible to prevent the meniscuses which are formed at the ink discharge ports 37 from being broken.

The lengths of the fiber on the surface of the absorbing member 50 are measured by observing the side end face of the absorbing member 50 with an optical microscope "AZ-100M" by NIKON, and measuring the distance between two points with a measuring tool. Specifically, fibers that protrude from the upper surface of the compressed and flattened absorbent member 50 are designated as targets of measurement, the two ends of protruding portions of the fibers are specified, and the distance therebetween is measured. The average value of the measurement results of ten fibers is designated as the length of the fibers on the surface of the absorbing member 50 as referred to here.

Further, it is preferable for the intervals of the fibers on the surface of the absorbing member 50 to be wider than the arrangement pitch of the nozzles (the intervals among adjacent nozzles). By adopting such a configuration, it will become possible to prevent the fibers of the absorbing member 50 from entering the ink ejection ports 37, and it will become possible to suppress breakage of the meniscuses which are formed in each of the ink ejection ports 37.

The intervals among the fibers on the surface of the absorbing member 50 are measured by observing the upper surface of the absorbing member 50 with an optical microscope "AZ-100M" manufactured by NIKON, and by measuring the distance between two points with a measuring tool. Specifically, compressed and flattened fibers that protrude from the upper surface of the absorbent member 50 are designated as targets of measurement. The distances between pairs of adjacent fibers are measured. Then, the average value of the measurement results of ten pairs of fibers is designated as the intervals among the fibers on the surface of the absorbing member 50 referred to here.

Example 1

The absorbency and surface roughness Rz of the absorbent member 50 as well as the pressing pressure and pressing time of the absorbent member 50 described above will be described below with reference to Examples and Comparative Examples.

First, a method for measuring the absorbency, the surface roughness Rz, the pressing pressure and the pressing time of the absorbing member 50 will be described.

With respect to the water absorbency, the target of measurement was not water but ink. The absorbency with respect to ink was measured by a method in accordance with the water absorption test based on the Birec method of JIS L 1907. Test pieces were 1 cm wide×20 cm long, the initial immersion length was 3 cm, and the immersion time was 5 min.

The surface roughness Rz, is a measured value of the maximum height roughness of ISO 25178 surface properties (measurement of surface roughness). A color 3D laser microscope "VK-8700" by KEYENCE was employed as a measuring instrument.

The pressing pressure was measured by fixing a push pull gauge (FGX-50R by Nidec Shimpo) at the same height as the mounting position of the inkjet head, placing the absorbing member on the pressing base, and pressing the absorbing member against the inkjet head. The amount of time for which the absorbing member is pressed against the ink jet head was designated as an amount of time from a point in time when the pressing pressure reached the values shown in Table 1 through Table 4 below to a point in time when the pressing was ceased.

Next, the evaluation method for each of the conditions will be described. Regarding evaluations, whether ink in the gap 40 of the nozzle guard 32 was removed (removal of gap ink), and whether ink was normally ejected from each nozzle (nozzle check) were evaluated.

First, prior to conducting the evaluations, purging was performed after the ink jet printing apparatus was used for a certain period of time. Next, the wipe cleaning operation described above was performed, and a nozzle check pattern which was set in advance was printed on a printing medium 15. Then, by visually checking the printing results, it was confirmed that ink was normally ejected from all of the nozzles.

Next, as an evaluation procedure, after purging, various absorption members 50 shown in Table 1 through Table 4 below were placed on the pressing base 100, and the pressing operation illustrated in FIG. 15C was performed at the pressing pressures and the amounts of pressing time shown in Table 1 through Table 4 below With respect to the removal of gap ink, the bottom surface 41 of the nozzle guard 32 (refer to FIG. 3 and FIG. 4) was pressed with a cotton swab after the pressing operation, and evaluations were conducted by visually checking whether ink seeps out from the gap 40. In Table 1 through Table 4, cases in which no ink seepage was observed were evaluated as "A", cases in which slight seepage of ink was observed were evaluated as "B", and cases in which there was a certain amount of ink seepage were was evaluated as "NG". The removal of gap ink is at a level at which there is no particular problem up to "B".

With respect to the nozzle check, a nozzle check pattern was printed after the pressing operation described above, and it was visually confirmed whether there were any nozzles from which ink was not normally ejected (ejection dropout). Note that a nozzle from which ink is not normally ejected is a nozzle in which breakage of a meniscus causes ejection failure. The number of nozzles that exhibit ejection dropout was counted per each single ink jet head 31. In Table 1 through Table 4 below, cases in which the number of nozzles that exhibited ejection dropout was 0 or greater and 3 or less were evaluated as "A", cases in which the number of nozzles that exhibited ejection dropout was 4 or greater and 9 or less were evaluated as "B", and cases in which the number of nozzles that exhibited ejection dropout was 10 or greater were evaluated as "NG". Note that the number of nozzles in one inkjet head 31 is 508. The ejection dropout is at a level at which there is no particular problem up to "B".

Next, specific Examples and Comparative Examples will be described. Table 1 shows the results of evaluations of ink removal and ejection dropout when the pressing operation described above was performed with Examples 1 to 8 and Comparative Examples 1 to 3 shown in Table 1 that employed various absorbing members 50 having different absorbencies and surface roughnesses Rz at the pressing pressures and amounts of pressing time shown in Table 1. Here, all of the pressing pressures was set to 30 kPa, and all of the amounts of pressing time were set to 10 seconds.

From the evaluation results shown in Table 1, it was found that it is preferable for the absorbency of the absorbing member 50 to be within a range of 10 mm/5 min or greater and 80 mm/5 min or less. In addition, it was found that it is preferable for the surface roughness Rz of the absorbing member 50 to be within a range of 410 μm or less.

TABLE 1

| | Absorbing Member | Material | Surface Roughness Rz (μm) | Absorbency (mm/5 min) | Pressing Pressure (kPa) | Pressing Time (seconds) | Gap Ink Removal | Nozzle Check |
|---|---|---|---|---|---|---|---|---|
| Example 1 | ASPURE Wiper (TM) | Polyester | 322.99 | 70 | 30 | 10 | A | A |
| Example 2 | Sponge Cloth | Cellulose 70% Cotton 30% | 322.31 | 80 | 30 | 10 | A | A |
| Example 3 | Printing Paper Arabel (TM) | Cellulose | 119.52 | 10 | 30 | 10 | A | B |
| Example 4 | Water Color Paper | Cellulose | 173.43 | 20 | 30 | 10 | A | A |
| Example 5 | Sofras (TM) | Polyurethane | 140.63 | 70 | 30 | 10 | A | A |
| Example 6 | Acoustic Mute Board (AMB) | Polyester | 340.6 | 80 | 30 | 10 | A | A |
| Example 7 | Cloth | Rayon 80% Polyester 20% | 322.73 | 70 | 30 | 10 | A | A |
| Example 8 | Felt 1 | Wool 60% Rayon 40% | 358.88 | 70 | 30 | 10 | A | A |
| Comparative Example 1 | Felt 2 | Wool 60% Rayon 40% | 414.78 | 70 | 30 | 10 | A | NG |
| Comparative Example 2 | Printing Paper Van Nouveau (TM) | Cellulose | 169.21 | 5 | 30 | 10 | NG | NG |
| Comparative Example 3 | Office Paper PW | Cellulose | 189.87 | 5 | 30 | 10 | NG | NG |

Next, Table 2 shows the results of evaluation by changing the pressing pressure employing the absorbing member 50 (printing paper Arabel (registered trademark)) of Example 3, which has an absorbency at the lower limit value. All of the amounts of pressing time were set to 10 seconds.

From the evaluation results shown in Table 2, it was found that it is preferable for the pressing pressure to be 10 kPa or greater and 80 kPa or less. Note that it is considered that the pressing pressure was excessively low for Comparative Example 4, and therefore removal of gap ink was evaluated as "NG". It is also considered that the pressing pressure was excessively high for Comparative Example 5, and therefore meniscuses were broken and nozzle check was evaluated as "NG".

TABLE 2

| | Absorbing Member | Material | Surface Roughness Rz (μm) | Absorbency (mm/5 min) | Pressing Pressure (kPa) | Pressing Time (seconds) | Gap Ink Removal | Nozzle Check |
|---|---|---|---|---|---|---|---|---|
| Example 9 | Printing Paper Arabel (TM) | Cellulose | 119.52 | 10 | 10 | 10 | B | A |
| Example 10 | Printing Paper Arabel (TM) | Cellulose | 119.52 | 10 | 15 | 10 | A | A |
| Example 11 | Printing Paper Arabel (TM) | Cellulose | 119.52 | 10 | 30 | 10 | A | A |
| Example 12 | Printing Paper Arabel (TM) | Cellnlose | 119.52 | 10 | 50 | 10 | A | A |
| Example 13 | Printing Paper Arabel (TM) | Cellulose | 119.52 | 10 | 80 | 10 | A | A |
| Comparative Example 4 | Printing Paper Arabel (TM) | Cellulose | 119.52 | 10 | 5 | 10 | NG | A |
| Comparative Example 5 | Printing Paper Arabel (TM) | Cellulose | 119.52 | 10 | 100 | 10 | A | NG |

Next, Table 3 shows the results of evaluations that were conducted by changing the pressing time using the absorbing member 50 (acoustic mute board (AMB)) of Example 6, which had an absorbency at the upper limit value. All of the pressing pressures were set to 30 kPa.

From the evaluation results shown in Table 3, it was found that it is preferable for the amount of pressing time to be 7 seconds or greater and 60 seconds or less. It is considered that the amount of pressing time was too short for Comparative Example 6, and therefore before the ink seeped out from the gap 40 of the nozzle guard 32 was absorbed by the absorbing member 50, the ink reached the ink discharge ports 37 of the nozzles, resulting in ejection failures and an evaluation of "NG" for nozzle check. In addition, it is considered that the amount of pressing time was too long for Comparative Example 7, resulting in meniscuses being broken and an evaluation of "NG" for nozzle check.

TABLE 3

| | Absorbing Member | Material | Surface Roughness Rz (μm) | Absorbency (mm/5 min) | Pressing Pressure (kPa) | Pressing Time (seconds) | Gap Ink Removal | Nozzle Check |
|---|---|---|---|---|---|---|---|---|
| Example 14 | Acoustic Mute Board (AMB) | Polyester | 340.6 | 80 | 30 | 7 | A | A |
| Example 15 | Acoustic Mute Board (AMB) | Polyester | 340.6 | 80 | 30 | 10 | A | A |
| Example 16 | Acoustic Mute Board (AMB) | Polyester | 340.6 | 80 | 30 | 20 | A | A |
| Example 17 | Acoustic Mute Board (AMB) | Polyester | 340.6 | 80 | 30 | 30 | A | A |
| Example 18 | Acoustic Mute Board (AMB) | Polyester | 340.6 | 80 | 30 | 60 | A | A |
| Comparative Example 6 | Acoustic Mute Board (AMB) | Polyester | 340.6 | 80 | 30 | 5 | A | NG |
| Comparative Example 7 | Acoustic Mute Board (AMB) | Polyester | 340.6 | 80 | 30 | 90 | A | NG |

Next, the results of evaluations that were conducted employing the absorbing member 50 of Example 3 (printing paper Arabel (registered trademark)), which had an absorbency at the lower limit value with pressing pressures of 10 kPa and 80 kPa, and amounts of pressing time of 7 seconds and 60 seconds, based on the evaluation results of Tables 1 through 3, are shown in Table 4 (Example 19 through Example 22). In addition, the results of evaluations that were conducted employing the absorbing member 50 of Example 6 (AMB), which had an absorbency at the upper limit value with pressing pressures of 10 kPa and 80 kPa, and amounts of pressing time of 7 seconds and 60 seconds are also shown in Table 4 (Example 23 through Example 26).

From the results in Table 4, it was found that it is preferable for the absorbency of the absorbing member 50 to be 10 mm/5 min or greater and 80 mm/5 min or less, for the pressing pressure to be 10 kPa or greater and 80 kPa or less, and for the amount of pressing time to be 7 seconds or greater and 60 seconds or less.

TABLE 4

| | Absorbing Member | Material | Surface Roughness Rz (μm) | Absorbency (mm/5 min) | Pressing Pressure (kPa) | Pressing Time (seconds) | Gap Ink Removal | Nozzle Check |
|---|---|---|---|---|---|---|---|---|
| Example 19 | Printing Paper Arabel (TM) | Cellulose | 119.52 | 10 | 10 | 7 | OK | A |
| Example 20 | Printing Paper Arabel (TM) | Cellulose | 119.52 | 10 | 10 | 60 | OK | A |
| Example 21 | Printing Paper Arabel (TM) | Cellulose | 119.52 | 10 | 80 | 7 | OK | A |
| Example 22 | Printing Paper Arabel (TM) | Cellulose | 119.52 | 10 | 80 | 60 | OK | A |
| Example 23 | Acoustic Mute Board (AMB) | Polyester | 340.6 | 80 | 10 | 7 | OK | A |
| Example 24 | Acoustic Mute Board (AMB) | Polyester | 340.6 | 80 | 10 | 60 | OK | A |

TABLE 4-continued

| | Absorbing Member | Material | Surface Roughness Rz (μm) | Absorbency (mm/5 min) | Pressing Pressure (kPa) | Pressing Time (seconds) | Gap Ink Removal | Nozzle Check |
|---|---|---|---|---|---|---|---|---|
| Example 25 | Acoustic Mute Board (AMB) | Polyester | 340.6 | 80 | 80 | 7 | OK | A |
| Example 26 | Acoustic Mute Board (AMB) | Polyester | 340.6 | 80 | 80 | 60 | OK | A |

Regarding the ink jet printing apparatus of the present invention, the following additional items will be disclosed. (Additional Items)

In the ink jet printing apparatus of the present invention, the pressing mechanism may have a cap member for sealing the opening of the nozzle guard during a standby state in which printing is not performed, and it is possible to press the absorbing member onto the opening of the nozzle guard in a state in which the absorbing member is set in the cap member, by moving at least one of the cap member and the ink jet head.

The ink jet printing apparatus of the present invention may have a supply pump for pressurizing and supplying ink to the ink jet head, a suction pump for suctioning ink which is absorbed by the absorbing member, and a control unit for controlling the supply pump and the suction pump, and the control unit may control the supply pump in a state in which the absorbing member is pressed onto the opening of the nozzle guard to eject ink from the ink jet head and may control the suction pump while ejecting the ink to perform suction.

In the ink jet printing apparatus of the present invention, a porous sheet having continuous open cells may be used as the absorbing member.

In the ink jet printing apparatus of the present invention, it is preferable for the absorbency of the absorbing member to be 10 mm/5 min or greater and 80 mm/5 min or less, for the surface roughness Rz of the absorbing member to be 410 μm or less, and for the pressing mechanism to press the absorbing member against the opening of the nozzle guard with a pressing pressure of 10 kPa or greater and 80 kPa or less for an amount of time 7 seconds or greater and 60 seconds or less.

In the ink jet printing apparatus of the present invention, it is preferable for the absorbing member to be formed by fibers which are thicker than the diameter of the nozzles.

In the ink jet printing apparatus of the present invention, it is preferable for the lengths of the fibers on the surface of the absorbing member to be shorter than the distance from the ink ejection surface of the nozzles to the surface of the nozzle guard.

In the ink jet printing apparatus of the present invention, it is preferable for the intervals among the fibers on the surface of the absorbing member to be wider than the arrangement pitch of the nozzles.

In the ink jet printing apparatus of the present invention, the absorbing member may include a liquid having solubility with respect to dried ink.

The ink jet printing apparatus of the present invention may be equipped with a conveyance mechanism for conveying the ink jet head in a direction orthogonal to the direction in which the nozzle row extends.

EXPLANATION OF THE REFERENCE NUMERALS

1 ink jet printing apparatus
2 shuttle base unit
3 flatbed unit
3*a* medium mounting surface
4 shuttle unit
5 control unit
11 gantry section
12 sub scanning drive motor
15 printing medium
21 casing
22 main scanning drive guide
23 main scanning drive motor
24 head elevating guide
25 head elevating motor
13A, 13B sub scanning drive guides
26 head unit
28 suction unit
29 absorption member setting mechanism
30 maintenance unit
31 ink jet head
32 nozzle guard
36 nozzle plate
36*a* ink ejection surface
37 ink ejecting port
40 gap
41 bottom plate
42 side wall
46 opening
50 absorbing member
51 ink tank
52 supply pump
53 ink supply pipe
54 elastic member
66 capping unit
67 cap elevating motor
68 suction pipe
69 suction pump
70 waste liquid tank
71 cap
72 cap base
76 bottom portion
77 peripheral wall
78 suction aperture
841 wiper
81*a* central portion
81*b* left portion
81*c* right portion
82 wiper fixing section
83 wiper driving unit
84 cleansing tank
86 wiper driving belt
87 drive roller
88, 89 driven rollers
90 pressing member
91 base
91*a* recess
91*b* bottom surface
92 installation base
93 spring member

94 suction aperture

100 pressing base

What is claimed is:

1. An ink jet printing apparatus, comprising:

an ink jet head having a nozzle row in which a plurality of nozzles for ejecting ink are arranged and a nozzle guard with an opening at a portion corresponding to the nozzle row, the nozzle guard being provided such that a peripheral edge of a nozzle plate in which the nozzle row is formed is covered via a gap defined between the nozzle guard and the nozzle plate;

a sheet shaped absorbing member having a size that covers a range of the opening of the nozzle guard; and a pressing mechanism for pressing the absorbing member onto the opening of the nozzle guard such that ink is removable from the nozzle plate at the opening of the nozzle guard and from the gap between the nozzle plate and the nozzle guard.

2. The ink jet printing apparatus as defined in claim 1, wherein:

the pressing mechanism comprises a cap member for sealing the opening of the nozzle guard during a standby state in which printing is not performed; and in a state in which the absorbing member is set in the cap member, the absorbing member is pressed onto the opening of the nozzle guard by moving at least one of the cap member and the ink jet head.

3. The ink jet printing apparatus as defined in claim 1, further comprising:

a supply pump for pressurizing and supplying ink to the ink jet head;

a suction pump for suctioning ink which is absorbed by the absorbing member; and a control unit for controlling the supply pump and the suction pump;

the control unit controlling the supply pump in a state in which the absorbing member is pressed onto the opening of the nozzle guard to eject ink from the ink jet head and controlling the suction pump while ejecting the ink to perform suction.

4. The ink jet printing apparatus as defined in claim 3, wherein:

the control unit sets the pressurizing conditions of the supply pump and the suction conditions of the suction pump to those that enable the ink within the gap between the ink ejection surface and the nozzles to be removed and the meniscus which is formed at each nozzle to be maintained.

5. The ink jet printing apparatus as defined in claim 3, wherein:

the control unit causes suctioning by the suction pump to be continued after pressurization by the supply pump is completed.

6. The ink jet printing apparatus as defined in claim 3, wherein:

the absorbing member is a porous sheet having continuous open cells.

7. An ink jet printing apparatus as defined claim 1, wherein:

an ink jet head having a nozzle row in which a plurality of nozzles for ejecting ink are arranged and a nozzle guard with an opening at a portion corresponding to the nozzle row, provided at a position via a gap with respect to an ink ejection surface of the nozzle row;

a sheet shaped absorbing member having a size that covers a range of the opening of the nozzle guard; and a pressing mechanism for pressing the absorbing member onto the opening of the nozzle guard, wherein intervals among fibers on a surface of the absorbing member are wider than an arrangement pitch of the nozzles.

8. The ink jet printing apparatus as defined in claim 1, wherein:

the absorbing member contains a liquid having solubility with respect to dried ink.

9. The ink jet printing apparatus as defined in claim 1, further comprising:

a conveyance mechanism for conveying the ink jet head in a direction orthogonal to a direction in which the nozzle row extends.

10. An ink jet printing apparatus comprising:

an ink jet head having a nozzle row in which a plurality of nozzles for ejecting ink are arranged and a nozzle guard with an opening at a portion corresponding to the nozzle row, provided at a position via a gap with respect to an ink ejection surface of the nozzle row;

a sheet shaped absorbing member having a size that covers a range of the opening of the nozzle guard; and a pressing mechanism for pressing the absorbing member onto the opening of the nozzle guard, wherein an absorbency of the absorbing member is 10 mm/5 min or greater and 80 mm/5 min or less; and a surface roughness Rz of the absorbing member is 410 μm or less.

11. An ink jet printing apparatus as defined in claim 10, wherein:

the pressing mechanism presses the absorbing member against the ink jet head with a pressing pressure of 10 kPa or greater and 80 kPa or less for an amount of time 7 seconds or greater and 60 seconds or less.

12. An ink jet printing apparatus comprising:

an ink jet head having a nozzle row in which a plurality of nozzles for ejecting ink are arranged and a nozzle guard with an opening at a portion corresponding to the nozzle row, provided at a position via a gap with respect to an ink ejection surface of the nozzle row;

a sheet shaped absorbing member having a size that covers a range of the opening of the nozzle guard; and a pressing mechanism for pressing the absorbing member onto the opening of the nozzle guard, wherein the absorbing member is formed by fibers which are thicker than thea diameter of each of the nozzles.

13. An ink jet printing apparatus comprising:

an ink jet head having a nozzle row in which a plurality of nozzles for ejecting ink are arranged and a nozzle guard with an opening at a portion corresponding to the nozzle row, provided at a position via a gap with respect to an ink ejection surface of the nozzle row;

a sheet shaped absorbing member having a size that covers a range of the opening of the nozzle guard; and a pressing mechanism for pressing the absorbing member onto the opening of the nozzle guard, wherein lengths of fibers on a surface of the absorbing member are shorter than a distance from the ink ejection surface of the nozzles to a surface of the nozzle guard.

* * * * *